US010310441B2

(12) United States Patent
Sakato et al.

(10) Patent No.: US 10,310,441 B2
(45) Date of Patent: Jun. 4, 2019

(54) ELECTROPHOTOGRAPHIC IMAGE FORMING APPARATUS, AND ELECTRICITY REMOVING MEMBER USED IN IMAGE FORMING APPARATUS

(71) Applicant: KYOCERA Document Solutions Inc., Osaka-shi, Osaka (JP)

(72) Inventors: Shingo Sakato, Osaka (JP); Nariaki Tanaka, Osaka (JP); Kiyotaka Kobayashi, Osaka (JP); Hiroka Itani, Osaka (JP); Takuji Watanabe, Osaka (JP); Eriko Hayashi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/081,152

(22) PCT Filed: Jan. 12, 2018

(86) PCT No.: PCT/JP2018/000636
§ 371 (c)(1),
(2) Date: Aug. 30, 2018

(87) PCT Pub. No.: WO2018/139219
PCT Pub. Date: Aug. 2, 2018

(65) Prior Publication Data

US 2019/0072894 A1 Mar. 7, 2019

(30) Foreign Application Priority Data

Jan. 27, 2017 (JP) ..... 2017-013229

(51) Int. Cl.
*G03G 21/06* (2006.01)
*G03G 15/00* (2006.01)
*G03G 15/02* (2006.01)

(52) U.S. Cl.
CPC ..... *G03G 21/06* (2013.01); *G03G 15/5004* (2013.01); *G03G 15/0216* (2013.01); *G03G 2221/0005* (2013.01)

(58) Field of Classification Search
CPC ..... G03G 15/1675; G03G 15/1605; G03G 15/0266; G03G 15/161; G03G 15/0216
See application file for complete search history.

(56) References Cited

U.S. PATENT DOCUMENTS

2016/0259264 A1* 9/2016 Matsuura ..... G03G 15/0266
2016/0274502 A1* 9/2016 Honda ..... G03G 15/1605
2017/0285506 A1* 10/2017 Itani ..... G03G 21/06

FOREIGN PATENT DOCUMENTS

JP 01154186 A 6/1989

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

In an image forming apparatus, a resistance component of an inner impedance of an electricity removing member is equal to or lower than a value that is obtained by multiplying a calculated resistance value by a first specific value, the calculated resistance value being calculated based on a predetermined formula as a DC resistance value of the electricity removing member that is required to reduce a pre-electricity-removal potential of a photoconductor to a predetermined post-electricity-removal potential during an electricity removal time, the first specific value being calculated based on a ratio of a linear speed of the electricity removing member to a linear speed of the photoconductor, and a resistance component of the contact impedance of the electricity removing member is equal to or lower than a value that is obtained by multiplying the calculated resistance value by a second specific value that is calculated based on the ratio.

14 Claims, 12 Drawing Sheets

FIG.7

| | INNER RESISTANCE COMPONENT | | CONTACT RESISTANCE COMPONENT | | LINEAR SPEED RATIO Sr | INNER CAPACITANCE COMPONENT | | CAPACITANCE RATIO | | ELECTRICITY REMOVING MEMBER CONDITIONS | | | | | EVALUATION RESULT | | |
|---|---|---|---|---|---|---|---|---|---|---|---|---|---|---|---|---|---|
| | Ra (Ω) | SATISFACTION OF CONDITION | Rb (Ω) | SATISFACTION OF CONDITION | | Ca (F) | SATISFACTION OF CONDITION | Cb/Ca | SATISFACTION OF CONDITION | RAW THREAD RESISTANCE (Ω) | FINENESS (μm) | DENSITY (KF/inch²) | CARBON DISTRIBUTION | SHAPE | ELECTRICITY REMOVING CAPABILITY | POTENTIAL STABILITY | IMAGE MEMORY |
| COMPARATIVE EXAMPLE 1 | 1.00E+07 | FAILURE | 3.00E+07 | FAILURE | 1 | 1.00E+07 | FAILURE | 3.00 | FAILURE | 1.00E+07 | 30 | 100 | ENTIRE DISTRIBUTION | OPENING AND TEARING | FAILURE | — | — |
| COMPARATIVE EXAMPLE 2 | 2.00E+06 | FAILURE | 5.00E+06 | FAILURE | 1 | 4.00E+05 | FAILURE | 2.00 | FAILURE | 1.00E+06 | 7 | 500 | ENTIRE DISTRIBUTION | OPENING AND TEARING | FAILURE | — | — |
| COMPARATIVE EXAMPLE 3 | 1.50E+05 | FAILURE | 1.20E+05 | FAILURE | 1 | 3.80E+05 | FAILURE | 0.79 | FAILURE | 1.00E+06 | 7 | 500 | ENTIRE DISTRIBUTION | CIRCULAR | FAILURE | — | — |
| COMPARATIVE EXAMPLE 4 | 6.80E+05 | FAILURE | 3.00E+05 | FAILURE | 1 | 5.80E+04 | SUCCESS | 0.69 | FAILURE | 1.00E+05 | 7 | 500 | ENTIRE DISTRIBUTION | CIRCULAR | FAILURE | — | — |
| COMPARATIVE EXAMPLE 5 | 1.50E+05 | FAILURE | 5.70E+04 | FAILURE | 1 | 6.50E+04 | SUCCESS | 0.38 | SUCCESS | 1.04E+05 | 6 | 550 | ENTIRE DISTRIBUTION | CIRCULAR | FAILURE | — | — |
| COMPARATIVE EXAMPLE 6 | 1.50E+05 | FAILURE | 6.30E+04 | FAILURE | 1 | 6.50E+04 | SUCCESS | 0.32 | SUCCESS | 1.00E+05 | 6 | 500 | ENTIRE DISTRIBUTION | CIRCULAR | FAILURE | — | — |
| COMPARATIVE EXAMPLE 7 | 6.50E+04 | SUCCESS | 1.30E+04 | SUCCESS | 1 | 1.50E+05 | FAILURE | 0.20 | SUCCESS | 1.00E+05 | 6 | 550 | ENTIRE DISTRIBUTION | CIRCULAR | SUCCESS | FAILURE | FAILURE |
| COMPARATIVE EXAMPLE 8 | 6.50E+04 | SUCCESS | 2.00E+04 | SUCCESS | 1 | 2.00E+05 | FAILURE | 0.50 | FAILURE | 1.00E+04 | 7 | 500 | ENTIRE DISTRIBUTION | CIRCULAR | SUCCESS | FAILURE | FAILURE |
| COMPARATIVE EXAMPLE 9 | 6.70E+04 | SUCCESS | 2.35E+04 | SUCCESS | 1 | 8.90E+04 | SUCCESS | 0.45 | FAILURE | 1.00E+05 | 6 | 580 | ENTIRE DISTRIBUTION | CIRCULAR | SUCCESS | FAILURE | FAILURE |
| COMPARATIVE EXAMPLE 10 | 1.50E+05 | FAILURE | 4.00E+04 | FAILURE | 1 | 3.80E+05 | FAILURE | 0.26 | SUCCESS | 1.00E+06 | 7 | 500 | OUTER LAYER (TWO LAYERS) | CIRCULAR | FAILURE | — | — |
| COMPARATIVE EXAMPLE 11 | 6.90E+03 | SUCCESS | 2.07E+02 | SUCCESS | 1 | 8.00E+05 | FAILURE | 0.40 | SUCCESS | 1.00E+05 | 10 | 300 | OUTER LAYER (TWO LAYERS) | CIRCULAR | SUCCESS | FAILURE | FAILURE |
| COMPARATIVE EXAMPLE 12 | 6.90E+04 | SUCCESS | 2.76E+04 | SUCCESS | 1 | 4.00E+05 | FAILURE | 0.80 | FAILURE | 5.00E+05 | 13 | 220 | OUTER LAYER (TWO LAYERS) | CIRCULAR | SUCCESS | FAILURE | FAILURE |
| COMPARATIVE EXAMPLE 13 | 6.90E+04 | SUCCESS | 2.90E+04 | FAILURE | 1 | 4.00E+05 | FAILURE | 0.80 | FAILURE | 5.04E+05 | 15 | 200 | OUTER LAYER (TWO LAYERS) | CIRCULAR | FAILURE | — | — |
| COMPARATIVE EXAMPLE 14 | 1.50E+05 | SUCCESS | 4.00E+04 | SUCCESS | 1.6 | 3.80E+05 | FAILURE | 0.26 | SUCCESS | 1.00E+06 | 7 | 500 | OUTER LAYER (TWO LAYERS) | CIRCULAR | SUCCESS | FAILURE | FAILURE |
| COMPARATIVE EXAMPLE 15 | 6.90E+04 | SUCCESS | 2.90E+04 | SUCCESS | 1.1 | 4.00E+05 | FAILURE | 0.80 | FAILURE | 5.04E+05 | 15 | 200 | OUTER LAYER (TWO LAYERS) | CIRCULAR | SUCCESS | FAILURE | FAILURE |
| DISCLOSURE EXAMPLE 1 | 3.00E+03 | SUCCESS | 3.00E+01 | SUCCESS | 1 | 1.50E+03 | SUCCESS | 0.20 | SUCCESS | 1.00E+04 | 7 | 500 | OUTER LAYER (TWO LAYERS) | CIRCULAR | SUCCESS | SUCCESS | SUCCESS |
| DISCLOSURE EXAMPLE 2 | 5.00E+03 | SUCCESS | 5.00E+01 | SUCCESS | 1 | 2.00E+03 | SUCCESS | 0.38 | SUCCESS | 5.80E+03 | 7 | 300 | OUTER LAYER (TWO LAYERS) | CIRCULAR | SUCCESS | SUCCESS | SUCCESS |
| DISCLOSURE EXAMPLE 3 | 5.50E+03 | SUCCESS | 1.10E+02 | SUCCESS | 1 | 1.00E+05 | SUCCESS | 0.40 | SUCCESS | 6.40E+03 | 7 | 300 | OUTER LAYER (TWO LAYERS) | CIRCULAR | SUCCESS | SUCCESS | SUCCESS |
| DISCLOSURE EXAMPLE 4 | 1.50E+05 | SUCCESS | 5.70E+04 | SUCCESS | 1.6 | 6.50E+04 | SUCCESS | 0.38 | SUCCESS | 1.04E+05 | 6 | 550 | ENTIRE DISTRIBUTION | CIRCULAR | SUCCESS | SUCCESS | SUCCESS |
| DISCLOSURE EXAMPLE 5 | 1.50E+05 | SUCCESS | 6.30E+04 | SUCCESS | 1.7 | 6.50E+04 | SUCCESS | 0.32 | SUCCESS | 1.00E+05 | 6 | 500 | ENTIRE DISTRIBUTION | CIRCULAR | SUCCESS | SUCCESS | SUCCESS |

ELECTROPHOTOGRAPHIC IMAGE FORMING APPARATUS, AND ELECTRICITY REMOVING MEMBER USED IN IMAGE FORMING APPARATUS

TECHNICAL FIELD

The present invention relates to an electrophotographic image forming apparatus and an electricity removing member.

BACKGROUND ART

In electrophotographic image forming apparatuses, an electrostatic latent image is formed on a charged photoconductor, then it is developed by toner and a toner image is formed on the photoconductor, and after the toner image is transferred therefrom to a sheet, charges that have remained on the photoconductor are removed by an electricity removing device. As an example of the electricity removing device, there known a configuration for removing charges from the photoconductor by causing a grounded electricity removing member to contact the photoconductor (for example, see PTL 1).

CITATION LIST

Patent Literature

[PTL 1] Japanese Patent Application Publication No. H01-154186

SUMMARY OF THE INVENTION

Problems to be Solved by the Invention

Meanwhile, in the configuration where the electricity removing member comes in contact with the photoconductor, electric characteristics of the electricity removing member, such as an inner resistance, may influence the electricity removing capability. However, not only the inner resistance of the electricity removing member but also a contact resistance of the electricity removing member may influence the electricity removing capability.

The present invention has been made in view of such conventional circumstances, and it is an object of the present invention to provide an image forming apparatus and an electricity removing member used in the image forming apparatus that can improve the electricity removing capability by taking the contact resistance into consideration.

Solution to the Problems

An image forming apparatus according to an aspect of the present invention includes a photoconductor and an electricity removing member electrically grounded and rotatably disposed to be in contact with a surface of the photoconductor. In the image forming apparatus, with regard to a resistance component of an inner impedance of the electricity removing member and a resistance component of a contact impedance of the electricity removing member that are calculated from a Cole-Cole plot obtained from measurement in a predetermined frequency range by an AC impedance method, the resistance component of the inner impedance is equal to or lower than a value that is obtained by multiplying a calculated resistance value by a first specific value, the calculated resistance value being calculated based on a predetermined formula as a DC resistance value of the electricity removing member that is required to reduce a pre-electricity-removal potential of the photoconductor to a predetermined post-electricity-removal potential during an electricity removal time that is obtained by dividing a contact width between the photoconductor and the electricity removing member by a linear speed of the photoconductor, the first specific value being calculated based on a ratio of a linear speed of the electricity removing member to the linear speed of the photoconductor, and the resistance component of the contact impedance is equal to or lower than a value that is obtained by multiplying the calculated resistance value by a second specific value that is calculated based on the ratio of the linear speed of the electricity removing member to a linear speed of the photoconductor.

Advantageous Effects of the Invention

According to the present invention, it is possible to provide an image forming apparatus and an electricity removing member used in the image forming apparatus that can improve the electricity removing capability by taking the contact resistance into consideration.

BRIEF DESCRIPTION OF THE DRAWINGS

FIG. 7 is a diagram showing invention examples and comparative examples.

DESCRIPTION OF EMBODIMENTS

The following describes embodiments of the present invention with reference to the accompanying drawings. It should be noted that the following embodiments are examples of specific embodiments of the present invention and should not limit the technical scope of the present invention.

First Embodiment

Figure 1:
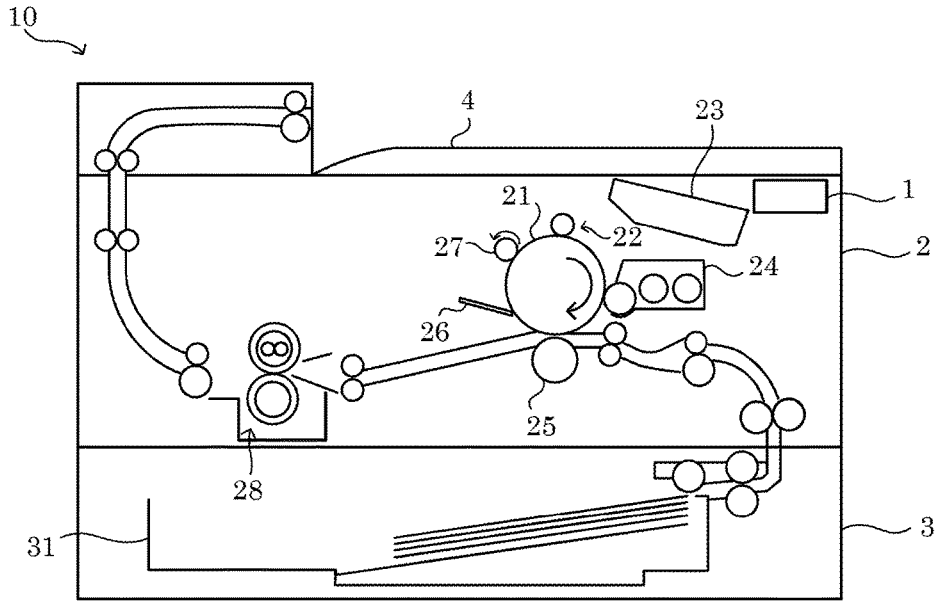
FIG. 1 is a diagram showing a configuration of an image forming apparatus according to a first embodiment of the present invention.

As shown in FIG. 1, an image forming apparatus 10 according to a first embodiment of the present invention is an electrophotographic monochrome printer and includes a control portion 1, an image forming portion 2, a sheet feed portion 3, and a sheet discharge portion 4. Other examples of the image forming apparatus according to the present invention include a facsimile, a copier, and a multifunction peripheral. In addition, the image forming apparatus according to the present invention is not limited to the image forming apparatus 10 supporting a monochrome printing as described in the first embodiment, but may be an electrophotographic color image forming apparatus of a tandem type or the like including a plurality of image forming portions for a plurality of colors.

The control portion 1 includes a CPU, a RAM, a ROM, and an EEPROM and controls the image forming apparatus 10 by causing the CPU to execute various processes in accordance with control programs stored in the ROM.

The image forming portion 2 is an electrophotographic image forming portion including a photoconductor drum 21, a charging device 22, a laser scanning device 23, a developing device 24, a transfer roller 25, a cleaning member 26, an electricity removing member 27, and a fixing device 28. It is noted that the photoconductor drum 21 is an example of the photoconductor, and the photoconductor is not limited to the photoconductor drum 21, but may be a photoconductor belt, for example.

In the image forming apparatus 10, the image forming portion 2, under the control of the control portion 1, executes an image forming process (print process) to form an image on a sheet such as a sheet of paper supplied from a sheet feed cassette 31 of the sheet feed portion 3, and the sheet after the image forming process is discharged to the sheet discharge portion 4.

Specifically, in the print process, the laser scanning device 23 scans a light beam on the surface of the photoconductor drum 21 charged by the charging device 22 so that an electrostatic latent image is formed based on image data. The electrostatic latent image formed on the surface of the photoconductor drum 21 is developed by the developing device 24, and is transferred to the sheet by the transfer roller 25.

Subsequently, the toner transferred to the sheet is fused and fixed to the sheet by the fixing device 28. It is noted that the toner that has remained on the surface of the photoconductor drum 21 is cleaned by the cleaning member 26. In addition, charges that have remained on the photoconductor drum 21 are removed by the electricity removing member 27 which is disposed on the downstream side of the cleaning member 26.

The photoconductor drum 21 is, for example, an organic photoconductor (OPC) having a single-layer structure in which a photosensitive layer is formed around an aluminum tube, wherein the photosensitive layer contains a charge generating material and a charge transport material. The charge generating material is, for example, a perylene-based pigment, a phthalocyanine-based pigment or the like. The change transport material is, for example, a hydrazone-based compound, a fluorenone-based compound, an arylanime-based compound or the like.

Specifically, the photoconductor drum 21 is a positive-charged single layer photoconductor (PSLP) drum. It is noted that as other embodiments, the photoconductor drum 21 may be an organic photoconductor having a multi-layer structure, or may be a negative-charged organic photoconductor.

Figure 2:
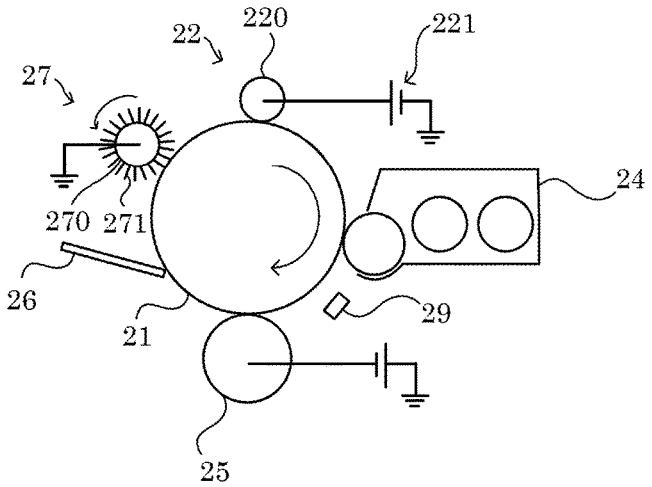
FIG. 2 is a diagram for explaining a main part of an image forming portion of the image forming apparatus according to the first embodiment of the present invention.

As shown in FIG. 2, the charging device 22 includes a charging roller 220 (an example of the charging member) that comes in contact with the photoconductor drum 21. A power supply 221 applies a positive DC voltage to the charging roller 220. This allows the charging roller 220 to apply a positive DC voltage to the photoconductor drum 21 so as to charge the photoconductor drum 21 to a predetermined charging potential. That is, the charging device 22 of the present embodiment is neither an AC-superposing-type charging device that superposes an AC voltage on a DC voltage, nor a contactless charging device, such as a scorotron charger, that charges the photoconductor drum 21 in a contactless manner. It is noted that as other embodiments, the charging device 22 may be an AC-superposing-type charging device or a contactless charging device.

The electricity removing member 27 is electrically grounded to the earth. In addition, the electricity removing member 27 is supported in such a way as to rotate while in contact with the surface of the photoconductor drum 21. Specifically, the electricity removing member 27 is a brush-like roller member formed from a conductive metal material or resin material. As shown in FIG. 2, the electricity removing member 27 includes a basic body portion 270 and brush bristles 271, wherein the basic body portion 270 is cylindrical, and one end of the brush bristles 271 is fixed to the basic body portion 270 and the other end is brought in contact with the surface of the photoconductor drum 21. In addition, the electricity removing member 27 is not limited to a brush-like shape, but may be a cylindrical (roll-shaped) roller member formed from a conductive metal material or resin material. The resin material is, for example, rubber or sponge.

Meanwhile, in a configuration where the electricity removing member 27 comes in contact with the photoconductor drum 21, as in the image forming apparatus 10, electric characteristics of the electricity removing member 27, such as the inner capacitance, may influence the potential stability and the memory image presence/absence on the surface of the photoconductor drum 21. However, not only the inner capacitance of the electricity removing member 27, but also the contact capacitence of the electricity removing member 27 may influence the potential stability and the memory image presence/absence.

In addition, in the image forming apparatus 10, an electric characteristic, such as an inner resistance, of the electricity removing member 27 influences the electricity removing capability. However, not only the inner resistance of the electricity removing member 27 but also a contact resistance of the electricity removing member 27 may influence the electricity removing capability. Specifically, since the photoconductor drum 21 has a high surface resistance value, a horizontal flow of charges does not occur on the surface of the photoconductor drum 21. As a result, even if the inner resistance of the electricity removing member 27 is low, if the contact resistance with the photoconductor drum 21 is high, charges cannot be removed effectively from the photoconductor drum 21.

In a case where, as in the first embodiment, the contact-type charging device 22 that contacts the photoconductor drum 21 is used, generation of VOC (volatile organic compounds) is suppressed, compared to a contactless charging device such as the scorotron charger that charges the photoconductor drum 21 in a contactless manner. However, contact-type charging devices may be inferior to contactless charging devices in charging performances. In addition, the charging device 22 is of a type that applies a DC voltage. This may lower the charging performance.

On the other hand, as described below, the image forming apparatus 10 is configured such that the electric characteristic of the electricity removing member 27 satisfies a preset first specific condition. With this configuration, it is possible to improve the potential stability by taking the contact capacitance also into consideration and suppress an occurrence of the memory image. In addition, as described below, the image forming apparatus 10 is configured such that the electric characteristic of the electricity removing member 27 satisfies a preset second specific condition. With this configuration, it is possible to improve the electricity removing capability by taking into consideration also the contact resistance of the electricity removing member 27.

Figure 3:
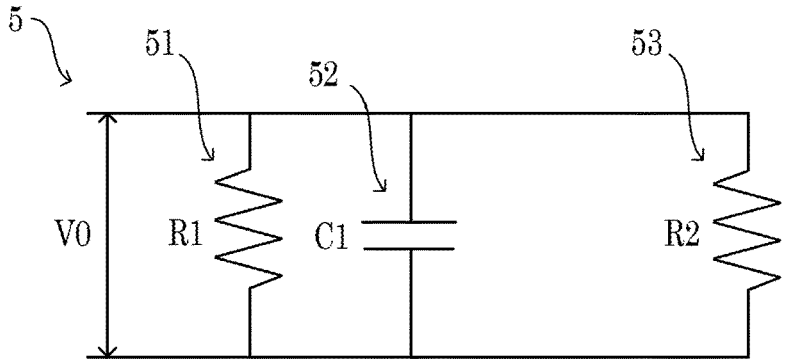
FIG. 3 is a diagram showing an equivalent circuit for explaining electric characteristics between a photoconductor and an electricity removing member of the image forming apparatus according to the first embodiment of the present invention.

As shown in FIG. 3, in an equivalent circuit 5 that indicates electric characteristics between the photoconductor drum 21 and the electricity removing member 27 of the image forming portion 2, a resistor 51, a capacitor 52, and a resistor 53 are connected in parallel, wherein the resistor 51 corresponds to a DC resistance value R1 of photoconductor drum 21, the capacitor 52 corresponds to a capacitance C of the photoconductor drum 21, and the resistor 53 corresponds to a DC resistance value R2 of the electricity removing member 27.

It is generally considered that in the equivalent circuit 5, the lower the DC resistance value R2 of the electricity removing member 27 is, the higher the electricity removing capability of the photoconductor drum 21 by the electricity removing member 27 is. However, it has been found that, in the actuality, not only the DC resistance value R2 of the electricity removing member 27, but also the contact resistance between the electricity removing member 27 and the photoconductor drum 21 influences the electricity removing capability.

Figure 4:
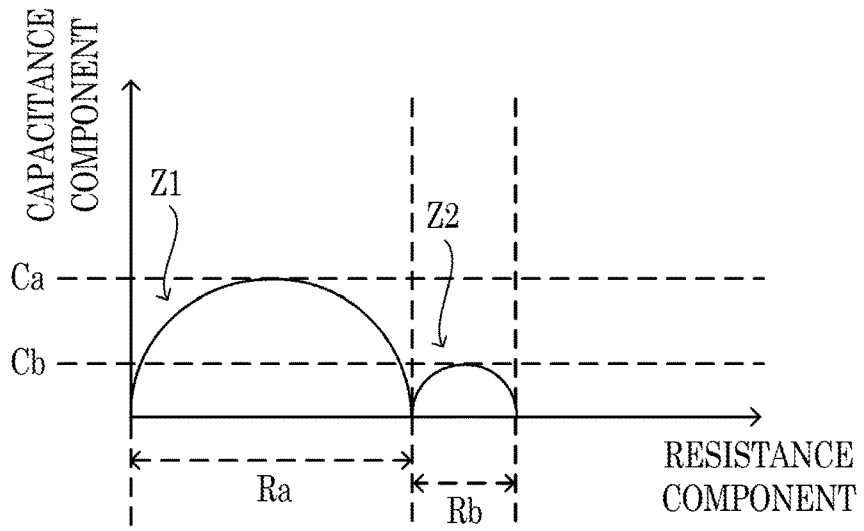
FIG. 4 is a diagram showing a Cole-Cole plot of the electricity removing member of the image forming apparatus according to the first embodiment of the present invention.

FIG. 4 shows a Cole-Cole plot that was obtained by measuring an inner impedance Z1 and a contact impedance Z2 of the electricity removing member 27 by the AC impedance method in a predetermined frequency range of, for example, 0.05 Hz to 100 kHz. It payable to calculate, from this plot, an inner resistance component Ra and an inner capacitance component Ca of the inner impedance Z1, and a contact resistance component Rb and a contact capacitance component Cb of the contact impedance Z2. Here, in the Cole-Cole plot shown in FIG. 4, the inner impedance Z1 and the contact impedance Z2 are plotted as semicircles. However, they may each be plotted as a circular arc such as a semielliptical shape.

In the first embodiment, it is assumed that the resistance between the core metal of the photoconductor drum 21 and the photosensitive layer can be ignored. In addition, the DC resistance value R1 of the photoconductor drum 21 is very high relative to the DC resistance value R2 of the electricity removing member 27. As a result, a combined resistance R3 of the photoconductor drum 21 and the electricity removing member 27 can be considered the same as the DC resistance value R2 of the electricity removing member 27.

Suppose here that "t" denotes an electricity removal time during which the photoconductor drum 21 is in contact with the electricity removing member 27, V1 denotes a post-electricity-removal potential that is determined in advance as a target value of the surface potential of the photoconductor drum 21 after an elapse of the electricity removal time t, V0 denotes a pre-electricity-removal potential of the photoconductor drum 21 at the start of the electricity removal by the electricity removing member 27, and C denotes the capacitance of the photoconductor drum 21. In this case, a theoretical value of DC resistance value R2 of the electricity removing member 27 (hereinafter, the value is referred to as "calculated resistance value R21") by which the surface potential of the photoconductor drum 21 is changed by electricity removal from the pre-electricity-removal potential V0 to the post-electricity-removal potential V1 during the electricity removal time t, is calculated based on the following formula (1). It is noted that when S denotes a linear speed (surface speed) of the photoconductor drum 21, and L denotes a contact width of the photoconductor drum 21 and the electricity removing member 27 in the rotation direction of the photoconductor drum 21, the electricity removal time t is calculated as L/S.

[Math 1]

$$V1=V0\times e^{-t/(R2\cdot C)} \quad (1)$$

However, as described above, the contact impedance of the electricity removing member 27 and the photoconductor drum 21 also influences the electricity removing capability of the electricity removing member 27. As a result, in the image forming apparatus 10, the electricity removing member 27 is configured in such a way as to satisfy the conditions of the following formulas (2) and (3) (the second specific condition)

[Math 2]

$$Ra\leq R21\times 3\times\{1+(|1-Sr|\times 1.9)\} \quad (2)$$

[Math 3]

$$Rb\leq R21\times 1.2\times\{1+(|1-Sr|\times 1.9)\} \quad (3)$$

That is, in the image forming apparatus 10, as shown in the formula (2), the inner resistance component Ra of the electricity removing member 27 is equal to or lower than a value obtained by multiplying the calculated resistance value R21 of the electricity removing member 27 by a first specific value that is calculated on a ratio Sr which is a ratio of the linear speed of the electricity removing member 27 to the linear speed of the photoconductor drum 21. In addition, in the image forming apparatus 10, as shown in the formula (3), the contact resistance component Rb of the electricity removing member 27 is equal to or lower than a value obtained by multiplying the calculated resistance value R21 of the electricity removing member 27 by a second specific value that is calculated based on the ratio Sr.

As described above, in the image forming apparatus 10, the electric characteristics of the electricity removing member 27 are determined by taking into consideration not only the DC resistance value R2 of the electricity removing member 27, but also the inner resistance component Ra and the contact resistance component Rb. With this configuration, it is possible to improve the electricity removing capability of the electricity removing member 27. On the other hand, the actual value of the DC resistance value R2 of the electricity removing member 27 may be equal to or lower than the calculated resistance value R21, or higher than the calculated resistance value R21.

Specifically, the electricity removing capability of the electricity removing member 27 is improved since the inner resistance component Ra and the contact resistance component Rb of the electricity removing member 27 are respectively equal to or lower than values that are defined based on: the calculated resistance value R21 which allows electricity to be removed to the post-electricity-removal potential V1 during the electricity removal time t; and the ratio Sr of the linear speed of the electricity removing member 27 to the linear speed of the photoconductor drum 21. It is noted that the first and second specific values are not limited to the above-mentioned values as far as similar effects are produced.

Figure 9:
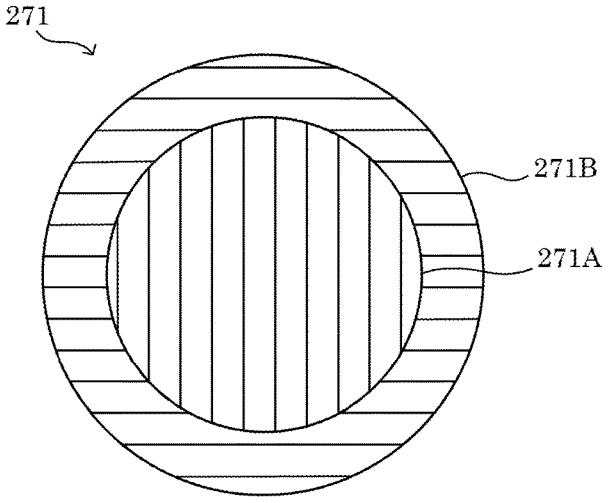
FIG. 9 is a diagram showing a configuration of a brush brittle of the electricity removing member of the image forming apparatus according to the first embodiment of the present invention.

For example, in the image forming apparatus 10, as shown in FIG. 9, each of the brush bristles 271 of the electricity removing member 27 includes a core portion 271A and a surface layer portion 271B. Here, FIG. 9 is a cross section of one brush bristle 271. The core portion 271A is made of resin. The surface layer portion 271B is made of carbon, and covers the surface of the core portion 271A. For example, surface layer portion 271B is formed together with the core portion 271A when the brush bristle 271 is manufactured. In addition, the surface layer portion 271B may be formed, after the core portion 271 is formed, by spraying carbon to the surface of the core portion 271A. With this configuration, compared to a configuration where each of the brush bristles 271 is composed of only a resin layer that contains carbon, it is possible to reduce the inner resistance component Ra and the contact resistance component Rb of the electricity removing member 27, while maintaining the strength of the brush bristles 271. It is noted that the surface layer portion 271B may contain a component other than carbon as far as the electricity removing member 27 satisfies the above-indicated formulas (2) and (3). In addition, the core portion 271A may contain carbon. In addition, each of the brush bristles 271 may be composed of only a resin layer that contains carbon.

In addition, in the image forming apparatus 10, the electricity removing member 27 rotates upon receiving a rotational driving force supplied from a first drive portion 272 (see FIG. 10) such as a motor. For example, the electricity removing member 27 rotates at a faster linear speed than the photoconductor drum 21. It is noted that the electricity removing member 27 may rotate at an equal speed to the photoconductor drum 21, or at a slower speed than the photoconductor drum 21. In addition, the electricity removing member 27 may rotate following the photoconductor drum 21 at a speed that is obtained be multiplying the linear speed of the photoconductor drum 21 by a predetermined ratio.

In addition, as described above, the contact impedance of the electricity removing member 27 with the photoconductor drum 21 also influences the potential stability and the image memory presence/absence on the surface of the photoconductor drum 21. In the image forming apparatus 10, the electricity removing member 27 is configured in such a way as to satisfy the conditions of the following formulas (4) and (5) (the first specific condition) as well.

$$Ca\leq 1.0E+05 \quad (4)$$

$$0\leq Cb/Ca\leq 0.4 \quad (5)$$

That is, in the image forming apparatus 10, as shown in the formula (4), the inner capacitance component Ca of the electricity removing member 27 is equal to or lower than "1.0E+05" that is an example of the predetermined fourth specific value. In addition, in the image forming apparatus 10, as shown in the formula (5), a capacitance ratio (Cb/Ca) that is obtained by dividing the contact capacitance component Cb of the electricity removing member 27 by the inner capacitance component Ca is equal to or lower than 0.4, wherein "0.4" is an example of the predetermined third specific value.

In this way, in the image forming apparatus 10, with the configuration where the electric characteristics of the electricity removing member 27 are determined by taking into consideration the inner capacitance component Ca and the contact capacitance component Cb of the electricity removing member 27, it is possible to improve the potential stability of the photoconductor drum 21 and suppress an occurrence of the image memory. Specifically, the inner capacitance component Ca is determined in such a way as to reduce the amount of charge that accumulates in the electricity removing member 27, and the ratio of the contact capacitance component Cb to the inner capacitance component Ca is low, thus the charge is likely to leak from the electricity removing member 27. This makes it possible to improve the potential stability and suppress an occurrence of the image memory. It is noted that the values of the third and fourth specific values are not limited to those described above as far as the similar effects are produced.

Examples

The following explains the measurement results of the image forming apparatus 10 with reference to FIG. 5 to FIG. 8.

Figure 5:
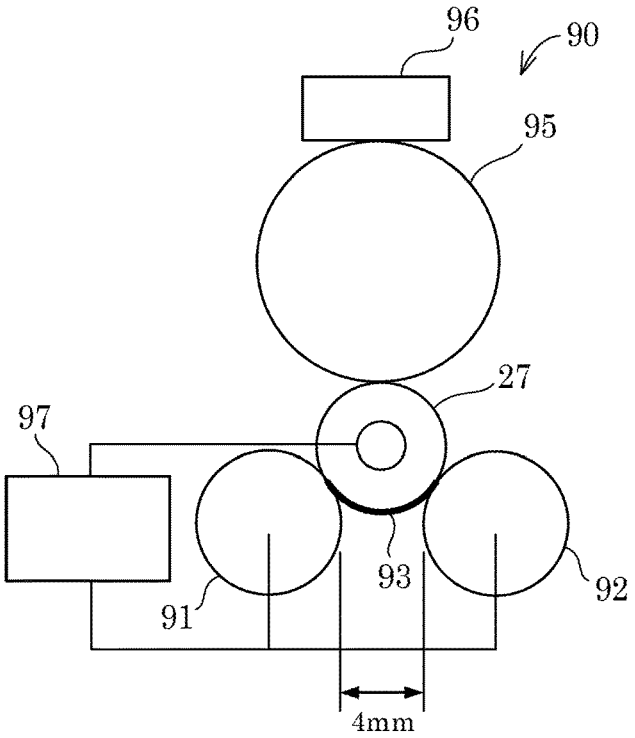
FIG. 5 is a diagram showing an experiment device used to obtain the Cole-Cole plot of the electricity removing member of the image forming apparatus according to the first embodiment of the present invention.
Figure 6:
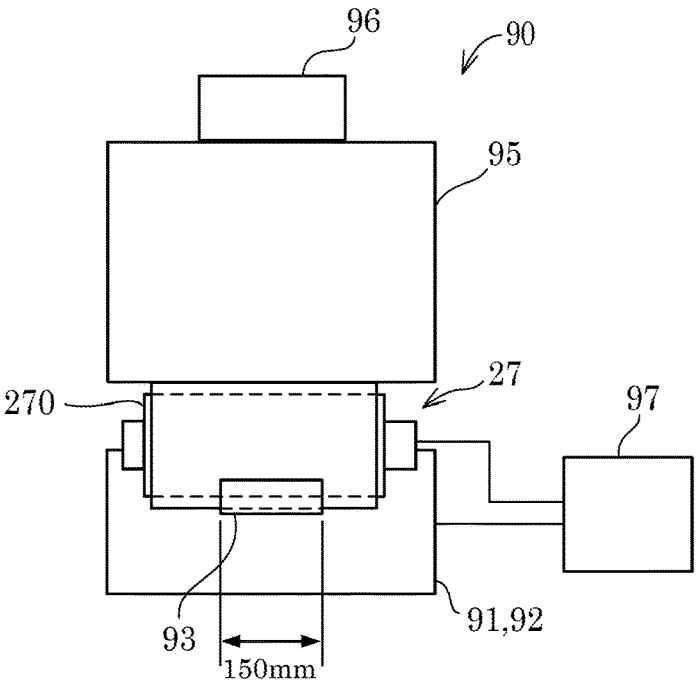
FIG. 6 is a diagram showing the experiment device used to obtain the Cole-Cole plot of the electricity removing member of the image forming apparatus according to the first embodiment of the present invention.

FIG. 5 and FIG. 6 show an experiment device 90 that measures the inner resistance component Ra, the contact resistance component Rb, the inner capacitance component Ca and the contact capacitance component Cb of the electricity removing member 27. The experiment device 90 includes two SUS rollers 91 and 92 aligned in the horizontal direction with 4 mm of distance therebetween, each of which is made of stainless steel and 18 mm in diameter. A film electrode 93 made of aluminum and having 150 mm of horizontal length is suspended between the SUS roller 91 and the SUS roller 92. Each of the electricity removing members 27 of comparative examples 1 to 15 and invention examples 1 to 5 that are the experiment objects, is disposed to be in contact with the upper surface of the film electrode 93.

In addition, the experiment device 90 includes a SUS roller 95 that has 30 mm of diameter and is disposed on the electricity removing member 27. A weight 96 of 1 kg applies a downward load to the SUS roller 95, and the load is applied to the electricity removing member 27 via the SUS roller 95. The experiment is conducted in a state where the electricity removing member 27 and the SUS rollers 91, 92 and 95 are not rotating. The two SUS rollers 91 and 92 are connected to one electrode of an impedance measuring equipment 97 (LCR HiTESTER 3522 made by Hioki E. E. Corporation), and a base body 81 of the electricity removing member 27 is connected to the other electrode of the impedance measuring equipment 97. In this state, the impedance measurement is performed by the impedance measuring equipment 97. In this experiment, a sinusoidal AC voltage whose voltage value is 5.0 V is applied to ends of the two electrodes of the impedance measuring equipment 97. The inner resistance component Ra, the contact resistance component Rb, the inner capacitance component Ca, and the contact capacitance component Cb of the electricity removing member 27 are measured while changing the frequency of the applied AC voltage in a range from 0.05 Hz to 100 kHz. The measurement was performed a plurality of times (2 to 16 times). The table of FIG. 7 shows experiment results based on the average values of the measured values.

FIG. 7 also shows results of evaluation on the print process executed by the image forming apparatus 10 loaded with each electricity removing member 27 of the examples shown in FIG. 7, with regard to the electricity removing capability of the electricity removing member 27 on removing electricity from the photoconductor drum 21, the potential stability, and the image memory presence/absence.

Here, with regard to the electricity removing capability, after the electricity removal of the photoconductor drum 21 had been performed by the electricity removing member 27, an evaluation was made on whether the potential of the photoconductor drum 21 was reduced to a desired post-electricity-removal potential V1. In FIG. 7, "success" and "failure" are used to indicate the evaluation result of the electricity removing capability, wherein "success" indicates that the potential was reduced to the desired post-electricity-removal potential V1, and "failure" indicates that the potential was not reduced to the desired post-electricity-removal potential V1

With regard to the potential stability, after a continuous printing of 60 minutes had been performed in the image forming apparatus 10, the surface potential of the photoconductor drum 21 after charging by the charging device 22 was measured, and an evaluation was made on whether the surface potential was reduced by 10% or more from the initial surface potential that had been measured after charging by the charging device 22 before the start of the continuous printing. In FIG. 7, "success" and "failure" are used to indicate the evaluation result of the potential stability, wherein "success" indicates that the surface potential was not reduced by 10% or more from the initial surface potential, and "failure" indicates that the surface potential was reduced by 10% or more from the initial surface potential. The reason why the value "10%" was adopted is that when the surface potential is reduced by 10% or more from the initial surface potential, a problem such as a fog may occur.

With regard to the image memory presence/absence, after the image forming process had been performed by the image forming apparatus 10 to form a black patch of a predetermined shape on the front end of the print sheet and form a half image (gray image) on the other region of the print sheet, an evaluation was made visually on whether or not an image memory was generated. Specifically, when the shape of the black patch appeared in the half image region, it was determined that an image memory was generated. In FIG. 7, "success" and "failure" are used to indicate the evaluation result of the image memory presence/absence, wherein "success" indicates that an image memory was not generated, and "failure" indicates that an image memory was generated.

More specifically, a remodeled version of printer "FS-1320DN" made by KYOCERA Document Solutions Inc. was used as the image forming apparatus 10 in the experiment. In addition, in the image forming apparatus 10, the pre-electricity-removal potential V0 of the photoconductor drum 21 was 500 V, the surface speed (linear speed) of the photoconductor drum 21 was 0.15 m/s, and the contact width L was 0.005 m. In addition, the vacuum permittivity $\varepsilon 0$ was (8.9E−12) F/m, the relative permittivity $\varepsilon r$ of the photoconductor drum 21 was 3.5, and the film thickness d of the photoconductor drum 21 was 3.5E−05 m. In this case, the capacitance C of the photoconductor drum 21 was calculated as 8.85E−07 F from "$\varepsilon 0 \times \varepsilon r/d$".

Furthermore, the post-electricity-removal potential V1 was set to 100 V, wherein the post-electricity-removal potential V1 is a desired potential after an electricity removal of the photoconductor drum 21 by the electricity removing member 27. In this case, from the above-indicated formula (1), the calculated resistance value R21 of the electricity removing member 27 is calculated as 2.34E+04 Ω. It is noted that the post-electricity-removal potential V1 may be calculated by, for example, an expression "V1=V0×0.2", or, to provide a margin, may be calculated by, for example, an expression "V1=V0×0.22+80".

Here, in the comparative examples 1 to 13 and the invention examples 1 to 3, the surface speed (linear speed) of the electricity removing member 27 was set to 0.15 m/s that was the same as a linear speed S of the photoconductor drum 21. As a result, in the comparative examples 1 to 13 and the invention examples 1 to 3, when the inner resistance component Ra of the electricity removing member 27 is equal to or lower than 7.02E+04 Ω that as three times the calculated resistance value R21, the formula (2) is satisfied. In addition, when the contact resistance component Rb of the electricity removing member 27 is equal to or lower than 2.81E +04 Ω that is 1.2 times the calculated resistance value R21, the formula (3) is satisfied.

On the other hand, in the comparative examples 14 to 15 and the invention examples 4 to 5, the linear speed of the electricity removing member 27 was set to a faster speed than the surface speed S of the photoconductor drum 21.

Specifically, in the comparative example 14, the linear speed of the electricity removing member 27 was set to 0.24 m/s that was 1.6 times the linear speed S of the photoconductor drum 21. As a result, in the comparative example 14, when the inner resistance component Ra of the electricity removing member 27 is equal to or lower than 1.502E+05 Ω that is 6.42 times the calculated resistance value R21, the formula (2) is satisfied. In addition, when the contact resistance component Rb of the electricity removing member 27 is equal to or lower than 6.01E +04 Ω that is 2.57 times the calculated resistance value R21, the formula (3) is satisfied.

In addition, in the comparative example 15, the linear speed of the electricity removing member 27 was set to 0.165 m/s that was 1.1 times the linear speed S of the photoconductor drum 21. As a result, in the comparative example 15, when the inner resistance component Ra of the electricity removing member 27 is equal to or lower than 8.35E+04 Ω that is 3.57 times the calculated resistance value R21, the formula (2) is satisfied. In addition, when the contact resistance component Rb of the electricity removing member 27 is equal to or lower than 3.35E +04 Ω that is 1.43 times the calculated resistance value R21, the formula (3) is satisfied.

In addition, in the invention example 4, the linear speed of the electricity removing member 27 was set to 0.24 m/s that was 1.6 times the linear speed S of the photoconductor drum 21. As a result, in the invention example 4, when the inner resistance component Ra of the electricity removing member 27 is equal to or lower than 1.502E+05 Ω that is 6.42 times the calculated resistance value R21, the formula (2) is satisfied. In addition, when the contact resistance component Rb of the electricity removing member 27 is equal to or lower than 6.01E+04 Ω that is 2.57 times the calculated resistance value R21, the formula (3) is satisfied.

In addition, in the invention example 5, the linear speed of the electricity removing member 27 was set to 0.255 m/s that was 1.7 times the linear speed S of the photoconductor drum 21. As a result, in the invention example 5, when the inner resistance component Ra of the electricity removing member 27 is equal to or lower than 1.64E+05 Ω that is 6.99 times the calculated resistance value R21, the formula (2) is satisfied. In addition, when the contact resistance component Rb of the electricity removing member 27 is equal to or lower than 6.55E+04 Ω that is 2.80 times the calculated resistance value R21, the formula (3) is satisfied.

In the comparative example 1, the electricity removing member 27 whose brush bristles 271 were raw threads that were prepared by performing an opening and tearing process on a conductive acrylic fiber SA7 made by Toray Industries, Incorporated, was used. In the electricity removing member 27 of the comparative example 1, the raw thread resistance was 1.00E+07 Ω, the brush fineness was 30 μm, namely high (fiber was thick), and the brush density was 100 kF/inch$^2$, namely low. It is noted that the comparative examples 1 to 9 were an entire distribution system where carbon of the fiber was distributed in the entire region of the raw thread. That is, in the electricity removing member 27 of the comparative examples 1 to 9, each of the brush bristles 271 is composed of only a resin layer that contains carbon.

In the comparative example 2, as in the comparative example 1, the electricity removing member 27 whose brush bristles 271 were raw threads that were prepared by performing an opening and tearing process on a conductive acrylic fiber SA7 made by Toray Industries, Incorporated, was used. In the electricity removing member 27 of the comparative example 2, the raw thread resistance was 1.00E+06 Ω, the brush fineness was 7 μm, namely low (fiber was thin), and the brush density was 500 kF/inch$^2$, namely high.

In the comparative example 3, the electricity removing member 27 whose brush bristles 271 were raw threads of a conductive nylon UUN made by Unitika Limited was used. In the electricity removing member 27 of the comparative example 3, the raw thread resistance was 1.00E+06 Ω, the brush fineness was 7 μm, namely low (fiber was thin), and the brush density was 500 kF/inch$^2$, namely high. It is noted that in the comparative examples 3 to 13 and the invention examples 1 to 3, the fiber cross sectional shape of the electricity removing member 27 was circular.

In the comparative examples 4 to 6, as in the comparative example 3, the electricity removing member 27 whose brush bristles 271 were raw threads of the conductive nylon UUN made by Unitika Limited was used. In the electricity removing member 27 of the comparative examples 4 to 6, the raw thread resistance was 1.00E+05 Ω, 1.04E+05 Ω, and 1.00E+05 Ω, respectively. In addition, in the electricity removing member 27 of the comparative examples 4 to 6, the brush fineness was 7 μm, 6 μm, and 6 μm, respectively. In addition, in the electricity removing member 27 of the comparative examples 4 to 6, the brush density was 500 kF/inch$^2$, 550 kF/inch$^2$, and 500 kF/inch$^2$, respectively.

In the comparative examples 7 to 9, as in the comparative example 3, the electricity removing member 27 whose brush bristles 271 were raw threads of the conductive nylon UUN made by Unitika Limited was used. On the other hand, the electricity removing member 27 of the comparative examples 7 to 9 had more amount of carbon in the fiber than the comparative example 3 so that values of the inner resistance component Ra and the contact resistance component Rb were smaller. In the electricity removing member 27 of the comparative examples 7 to 9: the raw thread resistance was 1.00E+05 Ω, 1.00E+04 Ω, and 1.00E+05 Ω, respectively; the brush fineness was 6 μm, 7 μm, and 6 μm, respectively, namely low (fiber was thin); and the brush density was 550 kF/inch$^2$, 500 kF/inch$^2$, and 580 kF/inch$^2$, respectively, namely high.

In the invention example 1, the electricity removing member 27 whose brush bristles 271 were raw threads of GBN fiber made by KB Seiren, Ltd was used. In the electricity removing member 27 of the invention example 1, the raw thread resistance was 1.00E+04 Ω, the brush fineness was 7 μm, namely low (fiber was thin), and the brush density was 500 kF/inch$^2$, namely high. In addition, in the electricity removing member 27 of the invention examples 1 to 3 and the comparative examples 10 to 13, the carbon presence state in the fiber was not the entire distribution system, but was a two-layer structure where carbon was present in the outer portion of the fiber, and the contact resistance component had been reduced and the resistance ratio (Rb/Ra) had become low. That is, in the electricity removing member 27 of the invention examples 1 to 3 and the comparative examples 10 to 13, each of the brush bristles 271 includes the core portion 271A and the surface layer portion 271B.

In the comparative example 10, as in the invention example 1, the electricity removing member 27 whose brush bristles 271 were raw threads of GBN fiber made by KB Seiren, Ltd was used, but the comparative example 10 was higher in raw thread resistance than the invention example 1 by two digits.

In the comparative examples 11 to 13, the brush-like electricity removing member 27 whose brush bristles 271 were threads prepared by spraying carbon to polyester raw threads, was used. In the electricity removing member 27 of the comparative examples 11 to 13, carbon was sprayed to the polyester raw threads such that values of the inner resistance component Ra and the contact resistance component Rb were smaller. It is noted that in the comparative examples 11 to 13 and the invention example 3, the same amount of carbon was sprayed, and the comparative examples 11 to 13 differed from the invention example 3 in fineness and density of the polyester raw threads.

In the invention example 2, the brush-like electricity removing member 27 whose brush bristles 271 were polyester raw threads was used. In the electricity removing member 27 of the invention example 2, the raw thread resistance was 5.80E+03 Ω, the brush fineness was 7 μm, namely low (fiber was thin), and the brush density was 300 kF/inch$^2$, namely high. In addition, in the invention example 2, as in the invention example 1, the electricity removing member 27 had the two-layer structure where carbon was present in the outer portion of the fiber, but carbon particles were directly sprayed to the outer portion of the fiber. With this configuration, the invention example 2 realized the same level of electric characteristic as the invention example 1, with a lower brush density than the invention example 1.

In the invention example 3, the brush-like electricity removing member 27 whose brush bristles 271 were polyester raw threads was used. In the electricity removing member 27 of the invention example 3, the raw thread resistance was 6.4E+03 Ω, the brush fineness was 7 μm, namely low (fiber was thin), and the brush density was 300 kF/inch$^2$, namely high. In addition, in the invention example 3, as in the invention example 1, the electricity removing member 27 had the two-layer structure where carbon was present in the outer portion of the fiber, but carbon particles were directly sprayed to the outer portion of the fiber. It is noted that in the invention example 3, a smaller amount of carbon was sprayed than in the invention example 2.

In the comparative example 14, the same electricity removing member 27 as in the comparative example 10 was used. In addition, in the comparative example 15, the same electricity removing member 27 as in the comparative example 13 was used. In addition, in the invention example 4, the same electricity removing member 27 as in the comparative example 5 was used. In addition, in the invention example 5, the same electricity removing member 27 as in the comparative example 6 was used.

As shown in FIG. 7, in the comparative examples 1 to 6 and 10, since the inner resistance component Ra exceeds 7.02E+04 Ω that is three times the calculated resistance value R21, the formula (2) is not satisfied. On the other hand, in the comparative examples 7 to 9 and 11 to 13, since the inner resistance component Ra is equal to or lower than 7.02E+04 Ω that is three times the calculated resistance value R21, the formula (2) is satisfied. In addition, in the comparative example 14, since the inner resistance component Ra is equal to or lower than 1.502E+05 Ω that is 6.42 times the calculated resistance value R21, the formula (2) is satisfied. Furthermore, in the comparative example 15, since the inner resistance component Ra is equal to or lower than 8.35E+04 Ω that is 3.57 times the calculated resistance value R21, the formula (2) is satisfied. However, in the comparative examples 1 to 6, 10 and 13, since the contact resistance component Rb exceeds 2.81E+04 Ω that is 1.2 times the calculated resistance value R21, the formula (3) is not satisfied. The comparative examples 1 to 6, 10 and 13 were evaluated as "failure" with regard to the electricity removing capability.

On the other hand, in the invention examples 1 to 3, since the inner resistance component Ra of the electricity removing member 27 is equal to or lower than 7.02E+04 Ω that is three times the calculated resistance value R21, the formula (2) is satisfied, and since the contact resistance component Rb is equal to or lower than 2.81E+04 Ω that is 1.2 times the calculated resistance value R21, the formula (3) is satisfied. In addition, in the invention example 4, since the inner resistance component Ra of the electricity removing member 27 is equal to or lower than 1.502E+05 Ω that is 6.42 times the calculated resistance value R21, the formula (2) is satisfied, and since the contact resistance component Rb is equal to or lower than 6.01E+04 Ω that is 2.57 times the calculated resistance value R21, the formula (3) is satisfied. Furthermore, in the invention example 5, since the inner resistance component Ra of the electricity removing member 27 is equal to or lower than 1.64E+05 Ω that is 6.99 times the calculated resistance value R21, the formula (2) is satisfied, and since the contact resistance component Rb of the electricity removing member 27 is equal to or lower than 6.55E+04 Ω that is 2.80 times the calculated resistance value R21, the formula (3) is satisfied. The invention examples 1 to 5 were evaluated as "success" with regard to the electricity removing capability.

Figure 8:
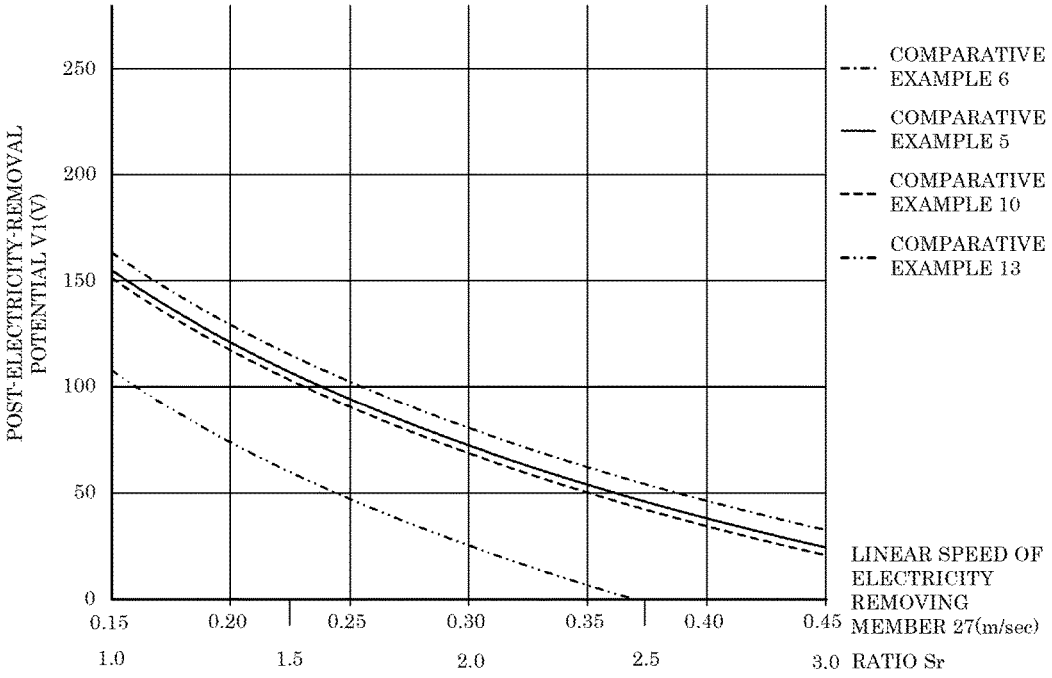
FIG. 8 is a diagram showing relationship between a post-electricity-removal potential and a ratio of a linear speed of the electricity removing member to a linear speed of the photoconductor in the image forming apparatus according to the first embodiment of the present invention.

Here, with regard to the electricity removing capability, the comparative example 5 was evaluated as "failure", while the invention example 4 that used the same electricity removing member 27 was evaluated as "success", which shows improvement in the electricity removing capability. In addition, with regard to the electricity removing capability, the comparative example 6 was evaluated as "failure, while the invention example 5 that used the same electricity removing member 27 was evaluated as "success", which shows improvement in the electricity removing capability. Similarly, with regard to the electricity removing capability, the comparative examples 10 and 13 were evaluated as "failure", while the comparative examples 14 and 15 that used the same electricity removing member 27 were evaluated as "success", which shows improvement in the electricity removing capability. These evaluation results show that it is possible to improve the electricity removing capability by setting the linear speed of the electricity removing member 27 to a speed that is faster than the linear speed S of the photoconductor drum 21. FIG. 8 shows relationships between the linear speed of the electricity removing member 27 and the post-electricity-removal V1 in the image forming apparatuses 10 in which the electricity removing members 27 according to the comparative examples 5 to 6, 10, and 13 were mounted.

In this way, it was found that, in the image forming apparatus 10, it is possible to obtain a desired electricity removing capability by taking into consideration not only the DC resistance value R2 of the electricity removing member 27, but also the inner impedance Z1 and the contact impedance Z2. More specifically, a desired electricity removing capability was obtained when the above-indicated formulas (2) and (3) were satisfied.

As shown in FIG. 7, values of the capacitance ratio (Cb/Ca) were calculated from the Cole-Cole plot obtained from measurement performed by the experiment device 90 on the electricity removing member 27 of the comparative examples 1 to 15 and the invention examples 1 to 5, wherein the capacitance ratio (Cb/Ca) is a ratio of the contact capacitance component Cb to the inner capacitance component Ca. Here, in the comparative examples 1 to 4, 8 to 9, 12 to 13 and 15, the capacitance ration (Cb/Ca) is higher than 0.4, and the condition of the above-indicated formula (5) that the capacitance ratio (Cb/Ca) is equal to or higher than 0 and equal to or lower than 0.4, is not satisfied. On the other hand, in the comparative examples 5 to 7, 10 to 11 and 14, the capacitance ration (Cb/Ca) is equal to or lower than 0.4, and the condition of the above-indicated formula (5) that the capacitance ratio (Cb/Ca) is equal to or higher than 0 and equal to or lower than 0.4, is satisfied. However, in the comparative examples 1 to 3, 7 to 8, and 10 to 15, the inner capacitance component Ca of the electricity removing member 27 is higher than 1.0E+5.0, and the condition of the above-indicated formula (4) that the inner capacitance component Ca is equal to or lower than 1.0E+5.0, is not satisfied. With regard to the potential stability and the image memory presence/absence, an evaluation was made only on the samples whose electricity removing capability had been evaluated as "success". Specifically, in the comparative examples 7 to 9, 11 to 12 and 14 to 15 whose electricity removing capability had been evaluated as "success", the potential stability and the image memory presence/absence were evaluated as "failure".

On the other hand, in the invention examples 1 to 5, the condition of the above-indicated formula (4) that the inner capacitance component Ca is equal to or lower than 1.0E+5.0, is satisfied, and the condition of the above-indicated formula (5) that the capacitance ratio (Cb/Ca) is equal to or higher than 0 and equal to or lower than 0.4, is satisfied. In addition, the invention examples 1 to 5 were evaluated as "success" with regard to the potential stability and the image memory presence/absence.

In this way, it was found that, in the image forming apparatus 10, it is possible to improve the potential stability and suppress an occurrence of the image memory by taking into consideration not only the DC resistance of the electricity removing member 27, but also the inner impedance Z1 and the contact impedance Z2. More specifically, the potential stability was improved and an occurrence of the image memory was suppressed when the conditions of the above-indicated formulas (4) and (5) were satisfied.

Meanwhile, in the image forming apparatus 10, an application voltage applied to the charging roller 220 that charges the photoconductor drum 21, is changed. Here, in a case where the electricity removing capability of the electricity removing member 27 is set based on the maximum value of the application voltage in a configuration where the electricity removing member 27 contacts the photoconductor drum 21, the wearing of the photoconductor drum 21 is accelerated and the life of the photoconductor drum 21 is shortened. On the other hand, in the image forming apparatus 10 according to the first embodiment of the present invention, as described below, it is possible to restrict the photoconductor drum 21 from wearing while securing necessary electricity removing capability.

Specifically, a first speed change program for causing the CPU to execute a first speed change process that is described below (see the flowchart of FIG. 11) is stored in advance in the ROM of the control portion 1. It is noted that the first speed change program may be recorded on a computer-readable recording medium such as a CD, a DVD, or a flash memory, and may be installed from the recording medium to a storage device such the EEPROM of the control portion 1 or the like.

Figure 10:
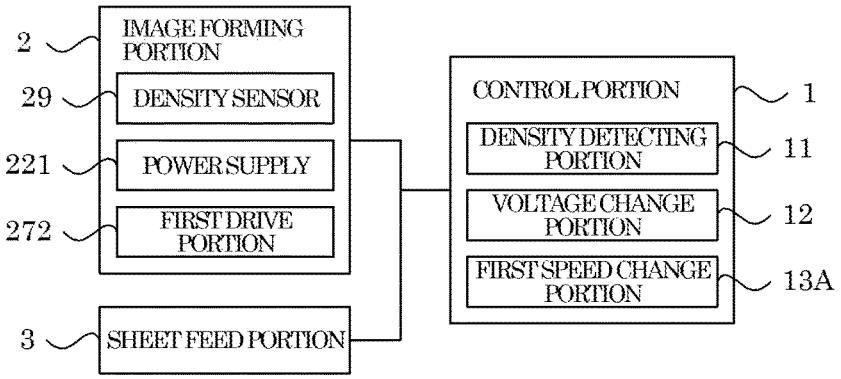
FIG. 10 is a block diagram showing a system configuration of the image forming apparatus according to the first embodiment of the present invention.

As shown in FIG. 10, the control portion 1 includes a density detecting portion 11, a voltage change portion 12, and a first speed change portion 13A. Specifically, the control portion 1 executes the first speed change program stored in the ROM by using the CPU, thereby functioning as the density detecting portion 11, the voltage change portion 12, and the first speed change portion 13A.

The density detecting portion 11 executes a density detection process of detecting density of a patch image that is formed on the surface of the photoconductor drum 21 based on predetermined image data.

Specifically, in the image forming apparatus 10, as shown in FIG. 2, a density sensor 29 is provided on a downstream side of the developing device 24 and on an upstream side of the transfer roller 25 in a rotation direction of the photoconductor drum 21. For example, the density sensor 29 is an optical sensor including a light emitting portion and a light receiving portion. In the density sensor 29, light emitted by the light emitting portion and reflected on the surface of the photoconductor drum 21 is received by the light receiving portion. The light receiving portion then outputs an electric signal that represents an amount of received light.

For example, when a predetermined first timing comes, the density detecting portion 11 forms the patch image on the surface of the photoconductor drum 21 by controlling the operation of each portion of the image forming portion 2. The density detecting portion 11 then detects the density of the patch image by using the density sensor 29. For example, the first timing is when the image forming apparatus 10 is powered on, when the image forming apparatus 10 returns to a normal state from a sleep state in which its partial functions are stopped, and when the print process is executed.

The voltage change portion 12 changes the application voltage that is applied from the power supply 221 to the charging roller 220.

Specifically, the voltage change portion 12 changes the application voltage based on the density of the patch image detected by the density detecting portion 11. It is noted that the voltage change portion 12 also changes a developing bias voltage that is applied to a developing roller provided in the developing device 24, as well as the application voltage.

For example, in the image forming apparatus 10, an initial setting value of the application voltage is set to 500 V. The voltage change portion 12 changes the application voltage from 500 V to 800 V when the density of the patch image detected by the density detecting portion 11 is thin in excess of a predetermined specific range. In addition, the voltage change portion 12 changes the application voltage from 500 V to 300 V when the density of the patch image is thick in excess of the specific range.

It is noted that the image forming apparatus 10 may include a temperature/humidity sensor that detects the temperature and humidity in the machine. In that case, the voltage change portion 12 may change the application voltage based on the temperature and humidity in the machine detected by the temperature/humidity sensor.

The first speed change portion 13A increases a difference between the linear speed of the photoconductor drum 21 and the linear speed of the electricity removing member 27 as the application voltage applied to the charging roller 220 increases. Here, the first speed change portion 13A is an example of the speed change portion of the present invention.

Specifically, the first speed change portion 13A changes the linear speed of the electricity removing member 27 to a first specific speed (an example of the specific speed of the present invention) so that the ratio Sr satisfies the following formulas (6) and (7) and the difference from the linear speed of the photoconductor drum 21 becomes the minimum, wherein R22 denotes a calculated resistance value calculated based on the above-mentioned formula (1) after the application voltage is changed by the voltage change portion 12. It is noted that the pre-electricity-removal potential V0 in the formula (1) is equal to the application voltage after a change by the voltage change portion 12 or is obtained by multiplying the application voltage after the change by a predetermined coefficient.

[Math 4]

$$Ra \leq R22 \times 3 \times \{1+(|1-Sr| \times 1.9)\} \quad (6)$$

[Math 5]

$$Rb \leq R22 \times 1.2 \times \{1+(|1-Sr| \times 1.9)\} \quad (7)$$

For example, in the image forming apparatus 10, as described above, the electricity removing member 27 rotates at a faster linear speed than the photoconductor drum 21. As a result, the first speed change portion 13A increases the difference between the linear speed of the photoconductor drum 21 and the linear speed of the electricity removing member 27 by increasing the linear speed of the electricity removing member 27. It is noted that in a case where the photoconductor drum 21 rotates at a faster linear speed than the electricity removing member 27, the first speed change portion 13A may increase the difference between the linear speed of the photoconductor drum 21 and the linear speed of the electricity removing member 27 by decreasing the linear speed of the electricity removing member 27.

For example, in the image forming apparatus 10, the inner resistance component Ra, the contact resistance component Rb, and the calculated resistance values R22 corresponding to application voltages that can be set in the image forming apparatus 10 are stored in the ROM of the control portion 1 in advance. In a case where the application voltage is changed by the voltage change portion 12, the first speed change portion 13A calculates a linear speed of the electricity removing member 27 that satisfies the above-described conditions, by using the inner resistance component Ra, the contact resistance component Rb, and the calculated resistance values R22 stored in the ROM. The first speed change portion 13A changes the linear speed of the electricity removing member 27 based on the calculation result.

It is noted that the first speed change portion 13A may change the linear speed of the electricity removing member 27 so that the difference from the first specific speed becomes equal to or smaller than a preset allowed value. In addition, the first speed change portion 13A may change the linear speed of the electricity removing member 27 so that the ratio Sr satisfies the above-described formulas (6) and (7).

Figure 12:
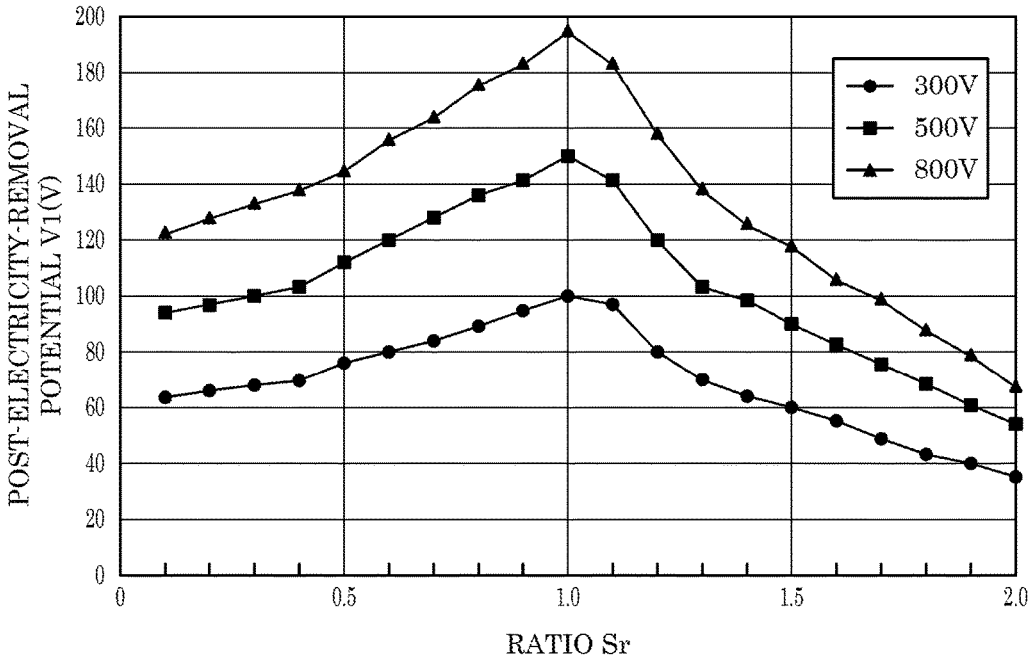
FIG. 12 is a diagram showing relationship between a post-electricity-removal potential and the ratio of the linear speed of the electricity removing member to the linear speed of the photoconductor in the image forming apparatus according to the first embodiment of the present invention.

In addition, in the image forming apparatus 10, first table data may be stored in the ROM of the control portion 1 in advance, wherein the first table data indicates linear speeds of the electricity removing member 27 that correspond to the application voltages that can be set in the image forming apparatus 10. In this case, when the application volume is changed by the voltage change portion 12, the first speed change portion 13A may change the linear speed of the electricity removing member 27 by using the first table data. For example, the first table data is generated based on experimental data that is obtained by an experiment conducted by using the image forming apparatus 10 to investigate the relationship between the post-electricity-removal potential V1 and the ratios Sr corresponding to the pre-electricity-removal potentials V0. Here, FIG. 12 shows an example of the experimental data obtained from the experiment.

In addition, the first speed change portion 13A may increase the difference between the linear speed of the photoconductor drum 21 and the linear speed of the electricity removing member 27 by changing the linear speed of the photoconductor drum 21.

[First Speed Change Process]

Figure 11:
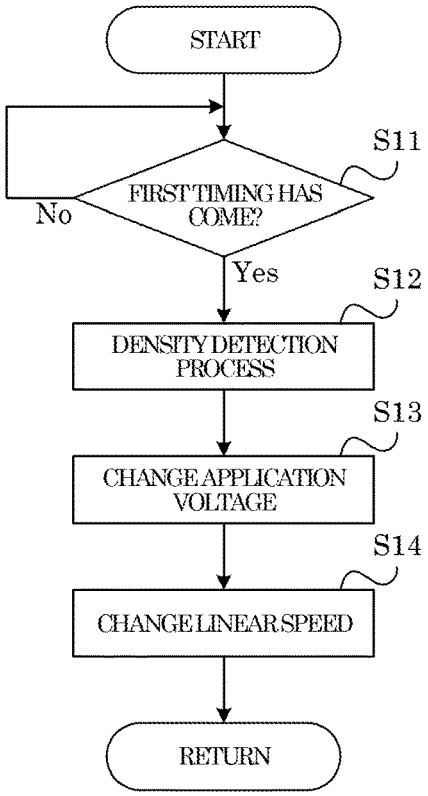
FIG. 11 is a flowchart showing an example of a first speed change process executed in the image forming apparatus according to the first embodiment of the present invention.

In the following, with reference to FIG. 11, a description is given of an example of the procedure of the first speed change process executed by the control portion 1 in the image forming apparatus 10. Here, steps S11, S12, . . . represent numbers assigned to the processing procedures (steps) executed by the control portion 1.

<Step S11>

First, in step S11, the control portion 1 determines whether or not the first timing has come.

Here, upon determining that the first timing has come (Yes side at S11), the control portion 1 moves the process to step S12. In addition, upon determining that the first timing has not come (No side at S11), the control portion 1 waits at step S11 for the first timing to come.

<Step S12>

In step S12, the control portion 1 executes the density detection process. Here, processes of steps S11 and S12 are executed by the density detecting portion 11 of the control portion 1.

For example, the control portion 1 forms the patch image on the surface of the photoconductor drum 21 by controlling the operation of each portion of the image forming portion 2. The control portion 1 then detects the density of the patch image by using the density sensor 29. It is noted that in step S12, the control portion 1 may detect the temperature and humidity in the machine, the image forming apparatus 10.

<Step S13>

In step S13, the control portion 1 changes the application voltage based on the density of the patch image detected in step S12. Here, process of step S13 is executed by the voltage change portion 12 of the control portion 1.

For example, when the density of the patch image detected in step S12 is thin in excess of the specific range, the control portion 1 changes the application voltage to 800 V by rewriting data stored in a predetermined first storage area in the RAM that indicates the set value of the application voltage. In addition, when the density of the patch image is thick in excess of the specific range, the control portion 1 changes the application voltage to 300 V by rewriting the data in the first storage area. In addition, when the density of the patch image is within the specific range, the control portion 1 changes the application voltage to 500 V by rewriting the data in the first storage area.

<Step S14>

In step S14, the control portion 1 changes the linear speed of the electricity removing member 27 based on the application voltage after the change in step S13. Here, the process of step S14 is executed by the first speed change portion 13A of the control portion 1.

Specifically, the control portion 1 changes the linear speed of the electricity removing member 27 to the first specific speed so that the ratio Sr satisfies the above-indicated formulas (6) and (7) and the difference from the linear speed of the photoconductor drum 21 becomes the minimum. For example, the control portion 1 changes the linear speed of the electricity removing member 27 by rewriting data stored in a predetermined second storage area in the RAM that indicates the set value of the linear speed of the electricity removing member 27.

As described above, in the image forming apparatus 10 according to the first embodiment, the higher the application voltage applied to the charging roller 220 is, the larger the difference between the linear speed of the photoconductor drum 21 and the linear speed of the electricity removing member 27 is. With this configuration, it is possible to restrict the photoconductor drum 21 from wearing while securing necessary electricity removing capability, compared to a configuration where the linear speed of the electricity removing member 27 is set based on the maximum value of the application voltage.

In addition, in the image forming apparatus 10 according to the first embodiment, the linear speed of the electricity removing member 27 is changed to the first specific speed so that the ratio Sr satisfies the above-indicated formulas (6) and (7) and the difference from the linear speed of the photoconductor drum 21 becomes the minimum. With this configuration, the difference between the linear speed of the photoconductor drum 21 and the linear speed of the electricity removing member 27 is minimized within a range where the necessary electricity removing capability is secured. Accordingly, it is possible to restrict the wearing of the photoconductor drum 21 more effectively.

It is noted that as a modification of the first embodiment, the difference between the linear speed of the photoconductor drum 21 and the linear speed of the electricity removing member 27 may be reduced as the surface potential of the photoconductor drum 21 is reduced due to deterioration over time or the like. For example, each time a predetermined period elapses, the first speed change portion 13A may reduce the linear speed of the electricity removing member 27. With this configuration, it is possible to restrict the wearing of the photoconductor drum 21 more effectively.

Second Embodiment

Figure 13:
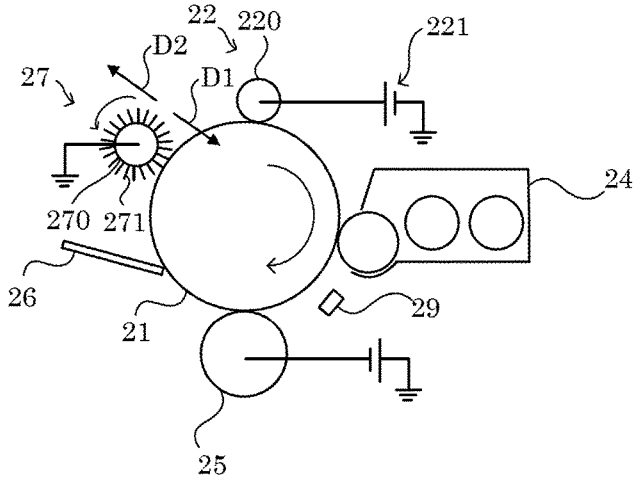
FIG. 13 is a diagram for explaining a main part of an image forming portion of an image forming apparatus according to a second embodiment of the present invention.
Figure 14:
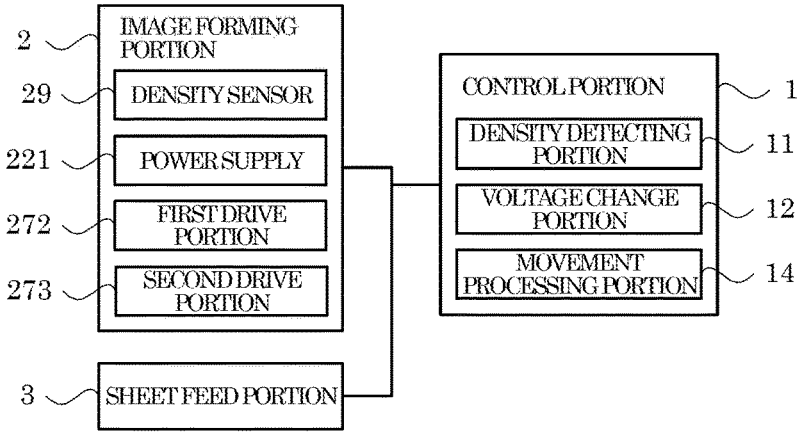
FIG. 14 is a block diagram showing a system configuration of the image forming apparatus according to the second embodiment of the present invention.
Figure 15:
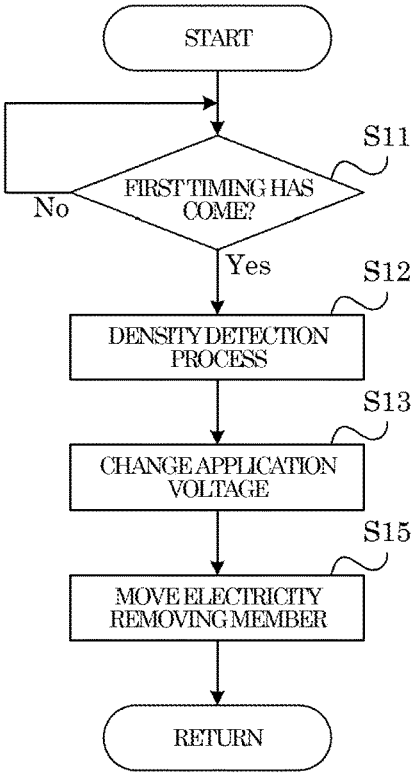
FIG. 15 is a flowchart showing an example of a contact pressure change process executed in the image forming apparatus according to the second embodiment of the present invention.

The following describes the image forming apparatus 10 according to a second embodiment of the present invention with reference to FIG. 13 to FIG. 15. The second embodiment differs from the first embodiment in configuration of the electricity removing member 27 and the control portion 1 in the image forming apparatus 10. Otherwise, the second embodiment has the same configuration as the first embodiment.

Specifically, in the image forming apparatus 10 according to the second embodiment, as shown in FIG. 13, the electricity removing member 27 is configured to move in a first direction D1 and a second direction D2, wherein the first direction D1 is a direction to approach the photoconductor drum 21, and the second direction D2 is opposite to the first direction D1. For example, in the image forming apparatus 10 according to the second embodiment, a bearing that supports a rotation shaft of the electricity removing member 27 is supported by a housing of the image forming apparatus 10 in such a way as to move in the first direction D1 and the second direction D2.

In addition, as shown in FIG. 14, the control portion 1 includes a movement processing portion 14 in place of the first speed change portion 13A.

Specifically, a contact pressure change program for causing the CPU to execute a contact pressure change process that is described below (see the flowchart of FIG. 15) is stored in advance in the ROM of the control portion 1. The control portion 1 executes the contact pressure change program stored in the ROM by using the CPU, thereby functioning as the density detecting portion 11, the voltage change portion 12, and the movement processing portion 14. It is noted that the density detecting portion 11 and the voltage change portion 12 are the same as those described in the first embodiment, and description thereof is omitted.

The movement processing portion 14 makes the separation distance between the photoconductor drum 21 and the electricity removing member 27 shorter as the application voltage applied to the charging roller 220 is higher. That is, the higher the application voltage applied to the charging roller 220 is, the higher the contact pressure between the photoconductor drum 21 and the electricity removing member 27 is. This allows the contact resistance component Rb between the photoconductor drum 21 and the electricity removing member 27 to be decreased.

Specifically, when the voltage change portion 12 increases the application voltage, the movement processing portion 14 decreases the separation distance between the photoconductor drum 21 and the electricity removing member 27 by moving the electricity removing member 27 in the first direction D1. In addition, when the voltage change portion 12 decreases the application voltage, the movement processing portion 14 increases the separation distance between the photoconductor drum 21 and the electricity removing member 27 by moving the electricity removing member 27 in the second direction D2.

For example, as shown in FIG. 14, the image forming apparatus 10 is provided with a second drive portion 273, such as a motor, configured to move the electricity removing member 27. In addition, in the image forming apparatus 10, second table data may be stored in the ROM of the control portion 1 in advance, wherein the second table data indicates positions of the electricity removing member 27 in its movable range that correspond to the application voltage that can be set in the image forming apparatus 10. When the voltage change portion 12 changes the application voltage, the movement processing portion 14 moves the electricity removing member 27 by using the second table data.

[Contact Pressure Change Process]

In the following, with reference to FIG. 15, a description is given of an example of the procedure of the contact pressure change process executed by the control portion 1 in the image forming apparatus 10. It is noted that among the steps included in the contact pressure change process, steps common to the first speed change process are indicated by the same reference signs, and description thereof is omitted.

<Step S15>

First, in step S15, the control portion 1 increases or decreases the separation distance between the photoconductor drum 21 and the electricity removing member 27 by moving the electricity removing member 27 in the first direction D1 or the second direction D2 depending on the application voltage after the change in step S13. Here, the process of step S15 is executed by the movement processing portion 14 of the control portion 1.

For example, when the application voltage is increased, the control portion 1 decreases the separation distance between the photoconductor drum 21 and the electricity removing member 27 by moving the electricity removing member 27 in the first direction D1 based on the second table data. In addition, when the application voltage is decreased, the control portion 1 increases the separation distance between the photoconductor drum 21 and the electricity removing member 27 by moving the electricity removing member 27 in the second direction D2 based on the second table data.

As described above, in the image forming apparatus 10 according to the second embodiment, the higher the application voltage applied to the charging roller 220 is, the smaller the separation distance between the photoconductor drum 21 and the electricity removing member 27 is. With this configuration, it is possible to restrict the photoconductor drum 21 from wearing while securing necessary electricity removing capability, compared to a configuration where the separation distance between the photoconductor drum 21 and the electricity removing member 27 is set based on the maximum value of the application voltage.

It is noted that the control portion 1 of the image forming apparatus 10 according to the second embodiment, may include the first speed change portion 13A. Specifically, the image forming apparatus 10 according to the second embodiment may be configured such that the higher the application voltage applied to the charging roller 220 is, the smaller the separation distance between the photoconductor drum 21 and the electricity removing member 27 is, and the larger the difference between the linear speed of the photoconductor drum 21 and the linear speed of the electricity removing member 27 is.

Meanwhile, in a configuration where the electricity removing member 27 comes in contact with the photoconductor drum 21, external additives contained in the toner, such as silica, may adhere to the electricity removing member 27. Here, when the amount of external additive adhered to the electricity removing member 27 increases, the contact resistance between the photoconductor drum 21 and the electricity removing member 27 increases, and the electricity removing capability is lowered.

Third Embodiment

The following describes the image forming apparatus 10 according to a third embodiment of the present invention with reference to FIG. 16 to FIG. 19. The third embodiment differs from the first embodiment in configuration of the control portion 1 and the image forming portion 2 in the image forming apparatus 10. Otherwise, the third embodiment has the same configuration as the first embodiment.

Specifically, in the image forming apparatus 10 according to the third embodiment, the image forming portion 2 does not include the density sensor 29.

Figure 16:
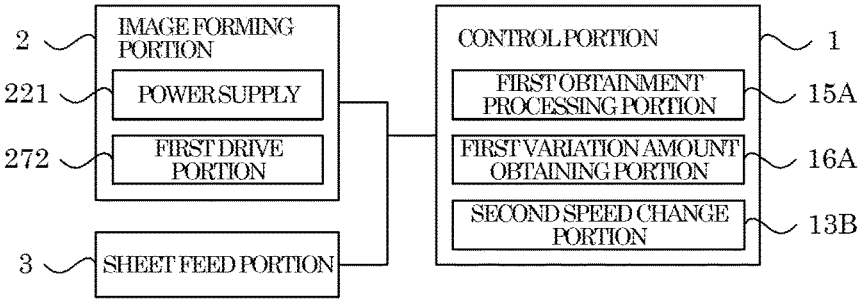
FIG. 16 is a block diagram showing a system configuration of an image forming apparatus according to a third embodiment of the present invention.

In addition, as shown in FIG. 16, the control portion 1 includes a first obtainment processing portion 15A, a first variation amount obtaining portion 16A, and a second speed change portion 13B in place of the density detecting portion 11, the voltage change portion 12, and first speed change portion 13A.

Specifically a second speed program for causing the CPU to execute a second speed change process that is described below (see the flowchart of FIG. 17) is stored in advance in the ROM of the control portion 1. The control portion 1 executes the second speed change program stored in the ROM by using the CPU, thereby functioning as the first obtainment processing portion 15A, the first variation amount obtaining portion 16A, and the second speed change portion 13B.

The first obtainment processing portion 15A obtains a cumulative value of consumption of toner (developer) based on a preset first obtainment condition.

For example, when a predetermined second timing comes, the first obtainment processing portion 15A obtains the cumulative value of consumption of toner. For example, as is the case with the first timing, the second timing is when the image forming apparatus 10 is powered on, when the image forming apparatus 10 returns to the normal state from the sleep state in which its partial functions are stopped, and when the print process is executed.

For example, in the image forming apparatus 10, a cumulative printing rate is stored in a predetermined third storage area in the EEPROM, wherein the cumulative printing rate is a cumulative value of a printing rate of each print that was output from the image forming apparatus 10. For example, when the print process is executed, the control portion 1 calculate a printing rate of each print output in the print process, based on image data that is printed in the print process. In addition, when the size of a sheet on which an image is printed in the print process is different from a predetermined reference size, the control portion 1 converts the calculated printing rate into a printing rate for a sheet of the reference size. The control portion 1 then updates the cumulative printing rate stored in the third storage area based on a total of the calculated or converted printing rates.

Subsequently, the first obtainment processing portion 15A obtains a cumulative value of consumption of toner based on the cumulative printing rate (an example of the first obtainment condition) stored in the third storage area. For example, the first obtainment processing portion 15A obtains the cumulative value of consumption of toner by multiplying the cumulative printing rate read from the third storage area by a predetermined coefficient.

It is noted that the first obtainment processing portion 15A may obtain the cumulative value of consumption of toner based on a cumulative number of prints (another example of the first obtainment condition) that is a cumulative value of the number of prints output from the image forming apparatus 10.

The first variation amount obtaining portion 16A obtains a variation amount ΔRb of the contact resistance component Rb of the contact impedance Z2 of the electricity removing member 27 based on the cumulative value of consumption of toner obtained by the first obtainment processing portion 15A.

Figure 18:
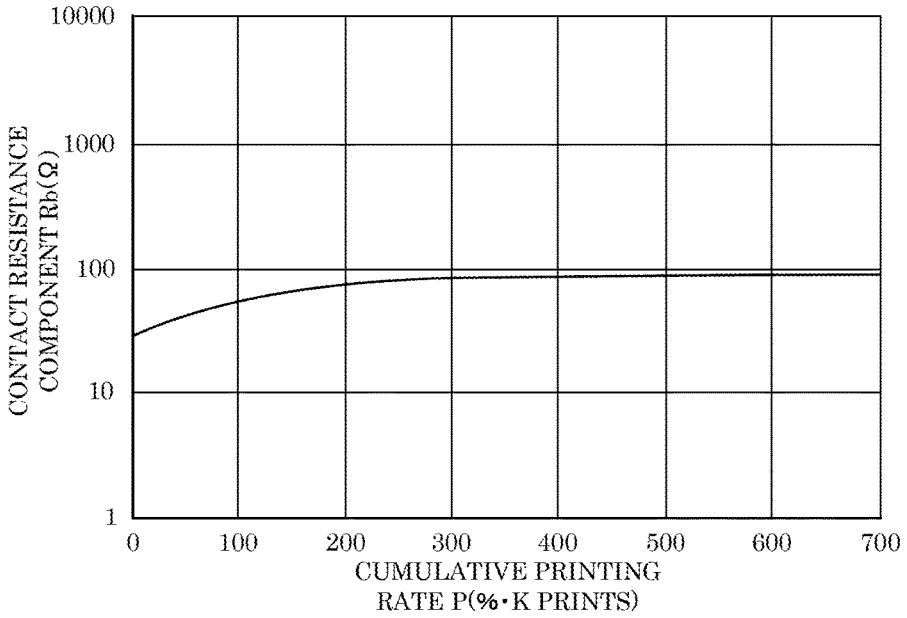
FIG. 18 is a diagram showing relationship between a cumulative printing rate and a contact resistance component of a contact impedance of the electricity removing member in the image forming apparatus according to the third embodiment of the present invention.

For example, in the image forming apparatus 10, third table data is stored in the ROM of the control portion 1 in advance, wherein the third table data indicates values of the variation amount ΔRb of the electricity removing member 27 that correspond to predetermined cumulative values of consumption of toner. The first variation amount obtaining portion 16A obtains the variation amount ΔRb of the contact resistance component Rb of the electricity removing member 27 based on the cumulative value of consumption of toner obtained by the first obtainment processing portion 15A and the third table data. For example, the third table data is generated based on experimental data that is obtained by an experiment conducted by using the image forming apparatus 10 to investigate the relationship between the cumulative value of consumption of toner in the image forming apparatus 10 and the contact resistance component Rb. Here, FIG. 18 shows an example of the experimental data obtained by the experiment. It is noted that FIG. 18 shows relationship between the contact resistance component Rb and a cumulative printing rate P used to calculate the cumulative value of consumption of toner.

It is noted that a formula (8) shown below may be stored in the ROM of the control portion 1 in advance, wherein the formula (8) indicates the variation amount ΔRb of the contact resistance component Rb and the cumulative printing rate P derived from the experimental data shown in FIG.

18. In this case, the first variation amount obtaining portion 16A may obtain the variation amount ΔRb of the contact resistance component Rb based on the following formula (8) and the cumulative printing rate P read from the third storage area. In addition, the control portion 1 may not include the first obtainment processing portion 15A. It is noted that in the following formula (8), F, G and H represent constants derived from the experimental data shown in FIG. 18.

[Math 6]

$$\Delta Rb = F \div (1 + G \times e^{-H \times P}) \quad (8)$$

The second speed change portion 13B increases the difference between the linear speed of the photoconductor drum 21 and the linear speed of the electricity removing member 27 in correspondence with an increase of the cumulative value of consumption of toner obtained based on the first obtainment condition.

Specifically, the second speed change portion 13B changes the linear speed of the electricity removing member 27 to a second specific speed so that the ratio Sr satisfies the above-indicated formula (2) and the following formula (9) and the difference from the linear speed of the photoconductor drum 21 becomes the minimum.

[Math 7]

$$Rb + \Delta Rb \leq R21 \times 1.2 \times \{1 + (|1 - Sr| \times 1.9)\} \quad (9)$$

For example, in the image forming apparatus 10, as described above, the electricity removing member 27 rotates at a faster linear speed than the photoconductor drum 21. As a result, the second speed change portion 13B increases the difference between the linear speed of the photoconductor drum 21 and the linear speed of the electricity removing member 27 by increasing the linear speed of the electricity removing member 27. It is noted that in a case where the electricity removing member 27 rotates at a slower linear speed than the photoconductor drum 21, the second speed change portion 13B may increase the difference between the linear speed of the photoconductor drum 21 and the linear speed of the electricity removing member 27 by decreasing the linear speed of the electricity removing member 27.

For example, in the image forming apparatus 10, the inner resistance component Ra, the contact resistance component Rb, and the calculated resistance value R21 are stored in the ROM of the control portion 1 in advance. In a case where the first variation amount obtaining portion 16A obtains the variation amount ΔRb of the contact resistance component Rb, the second speed change portion 13B calculates the linear speed of the electricity removing member 27 that satisfies the above-described conditions, by using the inner resistance component Ra, the contact resistance component Rb, and the calculated resistance value R21 stored in the ROM. The speed change portion 13B changes the linear speed of the electricity removing member 27 based on the calculation results.

It is noted that the second speed change portion 13B may change the linear speed of the electricity removing member 27 to a speed whose difference from the second specific speed is equal to or smaller than the allowed value. In addition, the second speed change portion 13B may change the linear speed of the electricity removing member 27 to a speed so that the ratio Sr satisfies the above-indicated formulas (2) and (9).

In addition, in the image forming apparatus 10, fourth table data may be stored in the ROM of the control portion 1 in advance, wherein the fourth table data indicates linear speeds of the electricity removing member 27 that correspond to predetermined cumulative values of consumption of toner. In this case, the second speed change portion 13B may change the linear speed of the electricity removing member 27 by using the fourth table data and the cumulative value of consumption of toner obtained by the first obtainment processing portion 15A. In addition, in this case, the control portion 1 may not include the first variation amount obtaining portion 16A. For example, the fourth table data is generated based on: experimental data that is obtained by an experiment conducted by using the image forming apparatus 10 to investigate the relationship between the cumulative value of consumption of toner in the image forming apparatus 10 and the post-electricity-removal potential V1; and experimental data that is obtained by an experiment conducted by using the image forming apparatus 10 to investigate the relationship between the ratio Sr and the post-electricity-removal potential V1.

In addition, the second speed change portion 13B may increase the difference between the linear speed of the photoconductor drum 21 and the linear speed of the electricity removing member 27 by changing the linear speed of the photoconductor drum 21. In addition, the second speed change portion 13B may increase the difference between the linear speed of the photoconductor drum 21 and the linear speed of the electricity removing member 27 within a range of equal to or lower than a preset upper-limit value.

[Second Speed Change Process]

Figure 17:
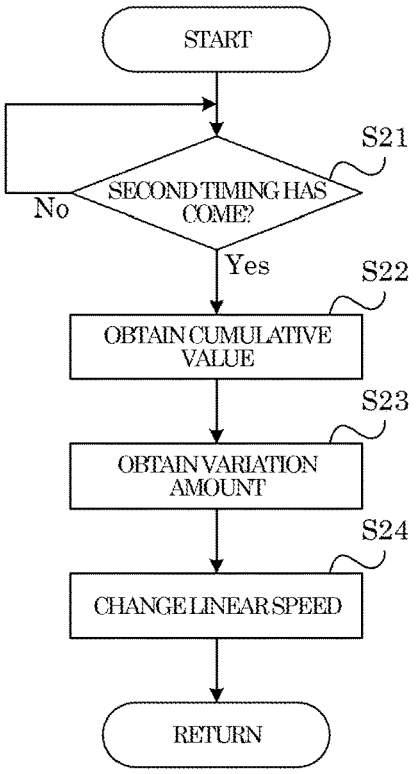
FIG. 17 is a flowchart showing an example of a second speed change process executed in the image forming apparatus according to the third embodiment of the present invention.

In the following, with reference to FIG. 17, a description is given of an example of the procedure of the second speed change process executed by the control portion 1 in the image forming apparatus 10.

<Step S21>

First, in step S21, the control portion 1 determines whether or not the second timing has come.

Here, upon determining that the second timing has come (Yes side at S21), the control portion 1 moves the process to step S22. In addition, upon determining that the second timing has not come (No side at S21), the control portion 1 waits at step S21 for the second timing to come.

<Step S22>

In step S22, the control portion 1 obtains the cumulative value of consumption of toner in the image forming apparatus 10. Here, the processes of steps S21 and S22 are executed by the first obtainment processing portion 15A of the control portion 1.

Specifically, the control portion 1 obtains the cumulative value of consumption of toner by multiplying the coefficient by the cumulative printing rate read from the third storage area.

<Step S23>

In step S23, the control portion 1 obtains the variation amount ΔRb of the contact resistance component Rb of the electricity removing member 27 based on the cumulative value of consumption of toner obtained in step S22. Here, the process of step S23 is executed by the first variation amount obtaining portion 16A of the control portion 1. It is noted that the process of step S23 may be omitted.

Specifically, the control portion 1 obtains the variation amount ΔRb of the contact resistant component Rb of the electricity removing member 27 based on the cumulative value of consumption of toner obtained in step S22 and the third table data.

<Step S24>

In step S24, the control portion 1 changes the linear speed of the electricity removing member 27 based on the variation amount ΔRb of the contact resistance component Rb of the electricity removing member 27 obtained in step S23. Here, the process of step S24 is executed by the second speed change portion 13B of the control portion 1.

Specifically, the control portion 1 changes the linear speed of the electricity removing member 27 to the second specific speed so that the ratio Sr satisfies the above-indicated formulas (2) and (9) and the difference from the linear speed of the photoconductor drum 21 becomes the minimum. For example, the control portion 1 changes the linear speed of the electricity removing member 27 by rewriting data stored in the second storage area in the RAM that indicates the set value of the linear speed of the electricity removing member 27.

As described above, in the image forming apparatus 10 according to the third embodiment, the difference between the linear speed of the photoconductor drum 21 and the linear speed of the electricity removing member 27 increases in correspondence with an increase of the cumulative value of consumption of toner obtained based on the first obtainment condition. This makes it possible to restrict the electricity removing capability of the electricity removing member 27 from being lowered due to an increase of the amount of external additives adhered to the electricity removing member 27.

In addition, in the image forming apparatus 10 according to the third embodiment, the linear speed of the electricity removing member 27 is changed to the second specific speed so that the ratio Sr satisfies the above-indicated formulas (2) and (9) and the difference from the linear speed of the photoconductor drum 21 becomes the minimum. With this configuration, the difference between the linear speed of the photoconductor drum 21 and the linear speed of the electricity removing member 27 is minimized within a range where the necessary electricity removing capability is secured. Accordingly, it is possible to restrict the wearing of the photoconductor drum 21.

It is noted that, as a modification of the third embodiment, in a configuration where a plurality of division areas are provided along a main scanning direction perpendicular to a conveyance direction of a sheet on which an image is formed, the cumulative printing rate is obtained for each of the plurality of division areas, and a division area that has the highest cumulative printing rate is referred to as a specific division area, the second speed change portion 13B may increase the difference between the linear speed of the photoconductor drum 21 and the linear speed of the electricity removing member 27 in correspondence with an increase of the cumulative value of consumption of toner which is obtained based on the cumulative printing rate of the specific division area. For example, a plurality of storage areas may be provided in the EEPROM of the control portion 1 so as to store the cumulative printing rates of the plurality of division areas respectively. In addition, the first obtainment processing portion 15A may obtain the cumulative value of consumption of toner by multiplying the cumulative printing rate of the specific division area by the number of division areas and the coefficient. With this configuration, it is possible to set the linear speed of the electricity removing member 27 based on a portion of the electricity removing member 27 to which the largest amount of external additives adheres, among a plurality of portions of the electricity removing member 27 set along the main scanning direction.

Figure 19:
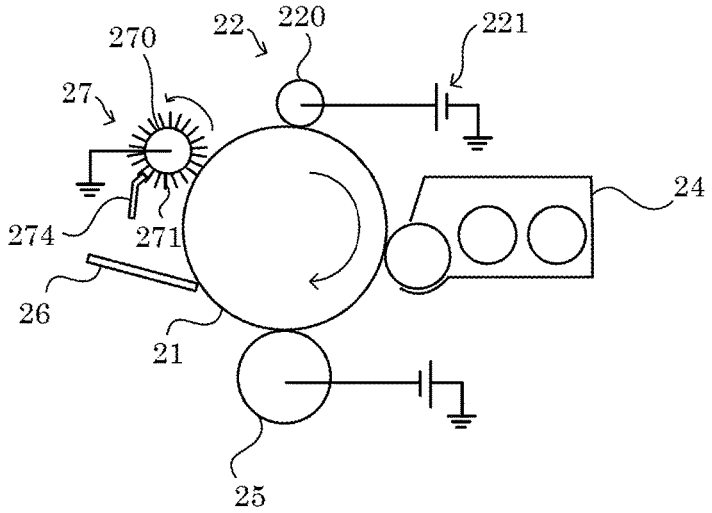
FIG. 19 is a diagram for explaining a main part of an image forming portion of an image forming apparatus according to a modification of the third embodiment of the present invention.

In a addition, as another modification of the third embodiment, as shown in FIG. 19, the image forming apparatus 10 may include a cleaning member 274 configured to clean the surface of the electricity removing member 27. For example, the cleaning member 274 is a blade-like member elongated in the axial direction of the rotation shaft of the photoconductor drum 21, and is provided in contact with the brush bristles 271 of the electricity removing member 27. For example, the cleaning member 274 is positioned so as to bite the electricity removing member 27 by 0.1 mm to 1.1 mm from the outer diameter of the electricity removing member 27. With this configuration, it is possible to restrict the external additives from adhering to the electricity removing member 27. It is noted that in a case where the cleaning member 274 is provided in the image forming apparatus 10, the contents of the third table data, the formula (8), and the fourth table data may be corrected.

Meanwhile, in a configuration where the electricity removing member 27 comes in contact with the photoconductor drum 21, tips of the brush bristles 271 that come in contact with the photoconductor drum 21 may be curved in such a way as to decrease the outer diameter of the electricity removing member 27 as the number of times the print process is executed increases. Here, when the outer diameter of the electricity removing member 27 is decreased, the contact area between the photoconductor drum 21 and the electricity removing member 27 is decreased, and the contact resistance between the photoconductor drum 21 and the electricity removing member 27 increases, resulting in reduction of the electricity removing capability of the electricity removing member 27.

Fourth Embodiment

The following describes the image forming apparatus 10 according to a fourth embodiment of the present invention with reference to FIG. 20 to FIG. 23. The fourth embodiment differs from the first embodiment in configuration of the control portion 1 and the image forming portion 2 in the image forming apparatus 10. Otherwise, the fourth embodiment has the same configuration as the first embodiment.

Specifically, in the image forming apparatus 10 according to the fourth embodiment, the image forming portion 2 does not include the density sensor 29.

Figure 20:
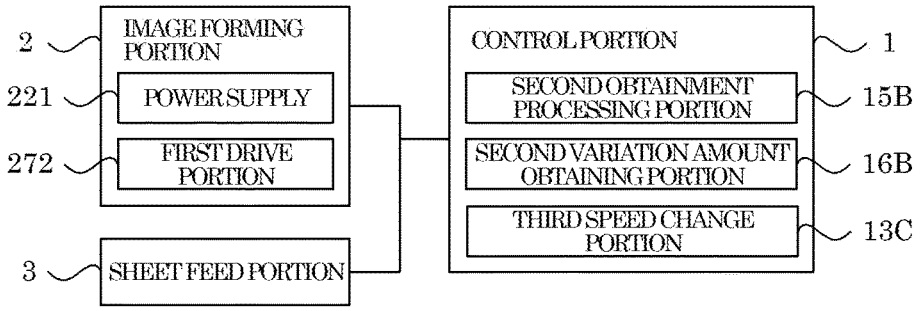
FIG. 20 is a block diagram showing a system configuration of an image forming apparatus according to a fourth embodiment of the present invention.

In addition, as shown in FIG. 20, the control portion 1 includes a second embodiment processing portion 15B, a second variation amount obtaining portion 16B, and a third speed change portion 13C in place of the density detecting portion 11, the voltage change portion 12, and the first speed change portion 13A.

Specifically, a third speed change program for causing the CPU to execute a third speed change process that is described below (see the flowchart of FIG. 21) is stored in advance in the ROM of the control portion 1. The control portion 1 executes the third speed change program stored in the ROM by using the CPU, thereby functioning as the second obtainment processing portion 15B, the second variation amount obtaining portion 16B, and the third speed change portion 13C.

The second obtainment processing portion 15B obtains an outer diameter of the electricity removing member 27 based on a preset second obtainment condition.

For example, when a predetermined third timing comes, the second obtainment processing portion 15B obtains the outer diameter of the electricity removing member 27. For example, as is the case with the first timing, the third timing is when the image forming apparatus 10 is powered on, when the image forming apparatus 10 returns to the normal state from the sleep state in which its partial functions are stopped, and when the print process is executed.

For example, the second obtainment processing portion 15B obtains the outer diameter of the electricity removing member 27 based on the cumulative number of prints (an example of the second obtainment condition) in the image forming apparatus 10.

For example, in the image forming apparatus 10, the cumulative number of prints in the image forming apparatus 10 is stored in a predetermined fourth storage area in the EEPROM. For example, each time the print process is executed, the control portion 1 updates the cumulative number of prints stored in the fourth storage area.

Figure 22:
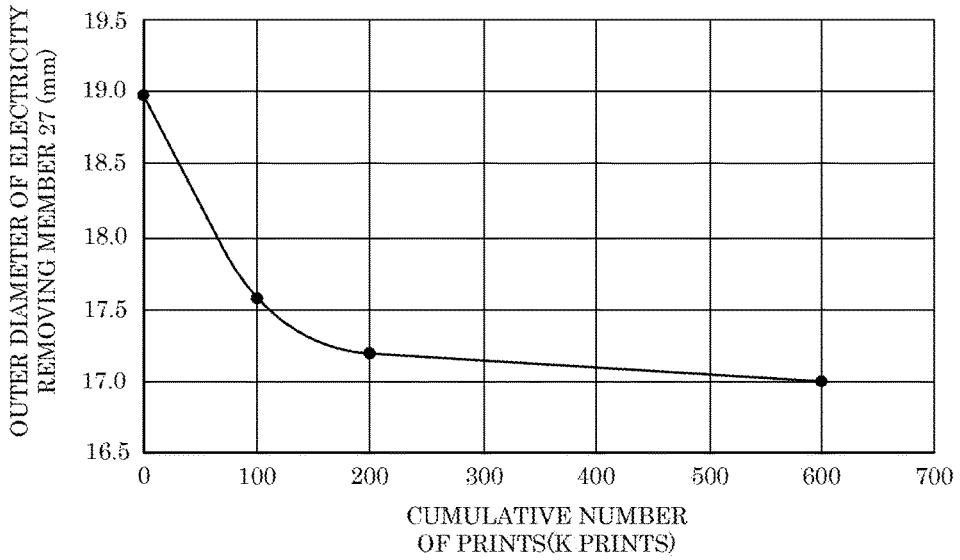
FIG. 22 is a diagram showing relationship between a cumulative number of prints and an outer diameter of the electricity removing member in the image forming apparatus according to the fourth embodiment of the present invention.

In addition, in the image forming apparatus 10, fifth table data may be stored in the ROM of the control portion 1 in advance, wherein the fifth table data indicates outer diameters of the electricity removing member 27 that correspond to predetermined cumulative numbers of prints. The second obtainment processing portion 15B obtains the outer diameter of the electricity removing member 27 based on the cumulative number of prints read from the fourth storage area and the fifth table data. For example, the fifth table data is generated based on experimental data that is obtained by an experiment conducted by using the image forming apparatus 10 to investigate the relationship between the cumulative number of prints and the outer diameter of the electricity removing member 27. Here, FIG. 22 shows an example of the experimental data obtained from the experiment.

It is noted that the second obtainment processing portion 15B may obtain the outer diameter the electricity removing member 27 based on a cumulative number of rotations (another example of the second obtainment condition) of the electricity removing member 27. In addition, the second obtainment processing portion 15B may obtain the outer diameter of the electricity removing member 27 based on a current value (a further example of the second obtainment condition) of current flowing through the first drive portion 272 that drives the electricity removing member 27. In addition, the second obtainment processing portion 15B may obtain the outer diameter of the electricity removing member 27 based on any two or more of the cumulative number of prints, the cumulative number of rotations, and the current value of the current flowing through the first drive portion 272. For example, the second obtainment processing portion 15B may obtain, as the outer diameter of the electricity removing member 27, an average value of an outer diameter of the electricity removing member 27 obtained based on the cumulative number of prints and an outer diameter of the electricity removing member 27 obtained based on the cumulative number of rotations.

The second variation amount obtaining portion 16B obtains the variation amount ΔRb of the contact resistance component Rb of the contact impedance Z2 of the electricity removing member 27 based on a decrease amount of the outer diameter of the electricity removing member 27 obtained by the second obtainment processing portion 15B.

For example, in the image forming apparatus 10, sixth table data may be stored in the ROM of the control portion 1 in advance, wherein the sixth table data indicates variation amounts ΔRb of the contact resistance component Rb of the electricity removing member 27 that correspond to predetermined decrease amounts of the outer diameter of the electricity removing member 27. The second variation amount obtaining portion 16B calculates the decrease amount of the outer diameter of the electricity removing member 27 based on: the outer diameter of the electricity removing member 27 obtained by the second obtainment processing portion 15B; and an outer diameter of the electricity removing member 27 at the time of manufacture of the image forming apparatus 10 that is stored in the ROM in advance. Subsequently, the second variation amount obtaining portion 16B obtains the variation amount ΔRb of the contact resistance component Rb of the electricity removing member 27 based on the calculated decrease amount of the outer diameter of the electricity removing member 27 and the sixth data table. For example, the sixth table data is generated based on experimental data that is obtained by an experiment conducted by using the image forming apparatus 10 to investigate the relationship between the decrease amount of the outer diameter of the electricity removing member 27 and the contact resistance component Rb.

The third speed change portion 13C increases the difference between the difference between the linear speed of the photoconductor drum 21 and the linear speed of the electricity removing member 27 in correspondence with a decrease in the outer diameter of the electricity removing member 27 obtained based on the second obtainment condition.

Specifically, the third speed change portion 13C changes the linear speed of the electricity removing member 27 to a third specific speed that the ratio Sr satisfies the above indicated formulas (2) and (9) and the difference from the linear speed of the photoconductor drum 21 becomes the minimum.

For example, in the image forming apparatus 10, as described above, the electricity removing member 27 rotates at a faster linear speed than the photoconductor drum 21. As a result, the third speed change portion 13C increases the difference between the linear speed of the photoconductor drum 21 and the linear speed of the electricity removing member 27 by increasing the linear speed of the electricity removing member 27. It is noted that in a case where the electricity removing member 27 rotates at a slower linear speed than the photoconductor drum 21, the third speed change portion 13C may increase the difference between the linear speed of the photoconductor drum 21 and the linear speed of the electricity removing member 27 by decreasing the linear speed of the electricity removing member 27.

For example, when the second variation amount obtaining portion 16B obtains the variation amount ΔRb of the contact resistance component Rb, the third speed change portion 13C calculates the linear speed of the electricity removing member 27 that satisfies the above-described conditions by using the inner resistance component Ra, the contact resistance component Rb, and the calculated resistance values R21 stored in the ROM. The third speed change portion 13C changes the linear speed of the electricity removing member 27 based on the calculation results.

It is noted that the third speed change portion 13C may change the linear speed of the electricity removing member 27 so that the difference from the third specific speed becomes equal to or smaller than the allowed value. In addition, the third speed change portion 13C may change the linear speed of the electricity removing member 27 so that the ratio Sr satisfies the above-described formulas (2) and (9).

In addition, in the image forming apparatus 10, seventh table data may be stored in the ROM of the control portion 1 in advance, wherein the seventh table data indicates linear speeds of the electricity removing member 27 that correspond to predetermined decrease amounts of the outer diameter of the electricity removing member 27. In this case, the third speed change portion 13C may change the linear speed of the electricity removing member 27 by using the seventh table data and the decrease amount of the outer diameter of the electricity removing member 27 obtained by the second obtainment processing portion 15B. In addition, in this case, the control portion 1 may not include the second variation amount obtaining portion 16B. For example, the seventh table data is generated based on experimental data that is obtained by an experiment conducted by using the image forming apparatus 10 to investigate the relationship between the decrease amount of the outer diameter of the electricity removing member 27 and the post-electricity-removal potential V1, and experimental data that is obtained by an experiment conducted by using the image forming apparatus 10 to investigate the relationship between the ratio Sr and the post-electricity-removal potential V1.

In addition, the third speed change portion 13C may increase the difference between the linear speed of the photoconductor drum 21 and the linear speed of the electricity removing member 27 by changing the linear speed of the photoconductor drum 21. In addition, the third speed change portion 13C may increase the difference between the linear speed of the photoconductor drum 21 and the linear speed of the electricity removing member 27 within a range of equal to or lower than a reset upper-limit value.

[Third Speed Change Process]

Figure 21:
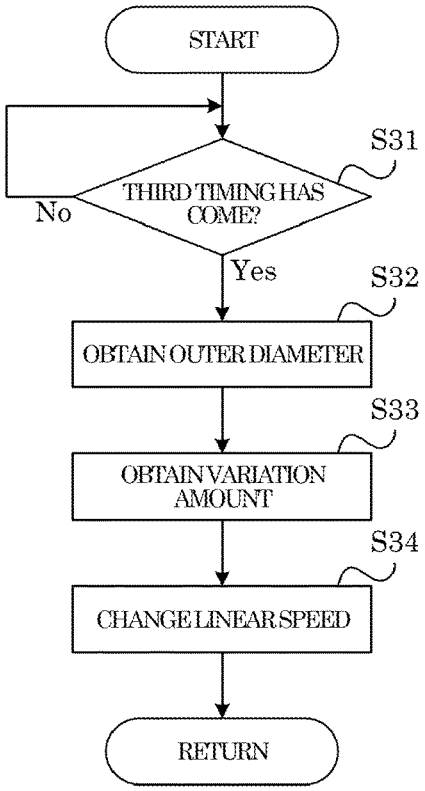
FIG. 21 is a flowchart showing an example of a third speed change process executed in the image forming apparatus according to the fourth embodiment of the present invention.

In the following, with reference to FIG. 21, a description is given of an example of the procedure of the third speed change process executed by the control portion 1 in the image forming apparatus 10.

<Step S31>

First, in step S31, the control portion 1 determines whether or not the third timing has come.

Here, upon determining that the third timing has come (Yes side at S31), the control portion 1 moves the process to step S32. In addition, upon determining that the third timing has not come (No side at S31), the control portion 1 waits at step S31 for the third timing to come.

<Step S32>

In step S32, the control portion 1 obtains the outer diameter of the electricity removing member 27. Here, the processes of steps S31 and S32 are executed by the second obtainment processing portion 15B of the control portion 1.

Specifically, the control portion 1 obtains the outer diameter of the electricity removing member 27 based on the fifth table data and the cumulative number of prints read from the fourth storage area.

<Step S33>

In step S33, the control portion 1 obtains the variation amount ΔRb of the contact resistance component Rb of the electricity removing remember 27 based on the decrease amount of the outer diameter of the electricity removing member 27 obtained in step S32. Here, the process of step S33 is executed by the second variation amount obtaining portion 16B of the control portion 1. It is noted that the process of step S33 may be omitted.

Specifically, the control portion 1 calculates the decrease amount of the outer diameter of the electricity removing member 27 based on: the outer diameter of the electricity removing member 27 obtained in step S32: and an outer diameter of the electricity removing member 27 at the time of manufacture of the image forming apparatus 10 that is stored in the ROM in advance. Subsequently, the control portion 1 obtains the variation amount ΔRb of the contact resistance component Rb of the electricity removing member 27 based on the calculated decrease amount of the outer diameter of the electricity removing member 27 and the sixth data table.

<Step S34>

In step S34, the control portion 1 changes the linear speed of the electricity removing member 27 based on the variation amount ΔRb of the contact resistance component Rb of the electricity removing member 27 obtained in step S33. Here, the process of step S34 is executed by the third speed change portion 13C of the control portion 1.

Specifically, the control portion 1 changes the linear speed of the electricity removing member 27 to the third specific speed so that the ratio Sr satisfies the above indicated formulas (2) and (9) and the difference from the linear speed of the photoconductor drum 21 becomes the minimum. For example, the control portion 1 changes the linear speed of the electricity removing member 27 by rewriting data stored in the second storage area in the RAM that indicates the set value of the linear speed of the electricity removing member 27.

As described above, in the image forming apparatus 10 according to the fourth embodiment, the difference between the linear speed of the photoconductor drum 21 and the linear speed of the electricity removing member 27 increases in correspondence with a decrease of the outer diameter of the electricity removing member 27 obtained based on the second obtainment condition. This makes it possible to restrict the electricity removing capability of the electricity removing member 27 from being lowered due to a decrease of the outer diameter of the electricity removing member 27.

In addition, in the image forming apparatus 10 according to the fourth embodiment, the linear speed of the electricity removing member 27 is changed to the third specific speed so that the ratio Sr satisfies the above-indicated formulas (2) and (9) and the difference from the linear speed of the photoconductor drum 21 becomes the minimum. With this configuration, the difference between the linear speed of the photoconductor drum 21 and the linear speed of the electricity removing member 27 is minimized within a range where the necessary electricity removing capability is secured. Accordingly, it is possible to restrict the wearing of the photoconductor drum 21.

Figure 23:
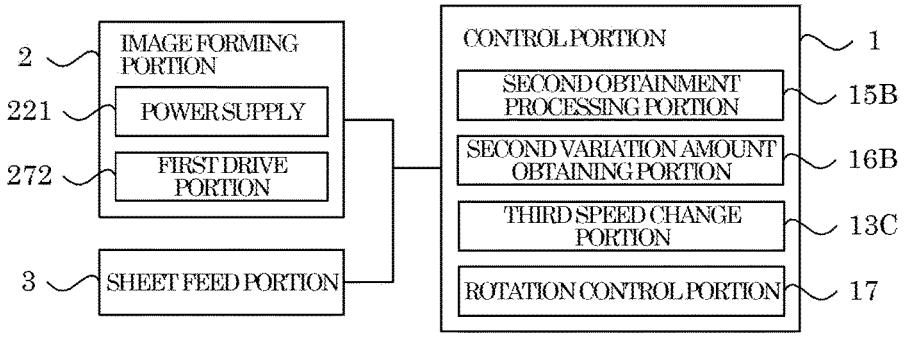
FIG. 23 is a block diagram showing a system configuration of an image forming apparatus according to a modification of the fourth embodiment of the present invention.

It is noted that, as a modification of the fourth embodiment, as shown in FIG. 23, the image forming apparatus 10 may include a rotation control portion 17. Specifically, each time the cumulative number of prints or the cumulative number of rotations increases by a predetermined reference value, the rotation control portion 17 rotates the electricity removing member 27 in a direction reverse to the rotation direction during execution of the print process, at a predetermined fourth timing that is different from a timing during the execution of the print process. For example, the rotation control portion 17 rotates the electricity removing member 27 in a direction revere to the rotation direction during execution of the print process, for a predetermined time period or a predetermined number of rotations. With this configuration, the curving of the tips of the brush bristles 271 is corrected at regular intervals, thereby making it possible to restrict the outer diameter of the electricity removing member 27 from decreasing. It is noted that in a case where the rotation control portion 17 is provided in the image forming apparatus 10, the contents of the fifth table data may be corrected.

The invention claimed is:

1. An image forming apparatus comprising:

a photoconductor; and an electricity removing member electrically grounded and rotatably disposed to be in contact with a surface of the photoconductor, wherein with regard to a resistance component of an inner impedance of the electricity removing member and a resistance component of a contact impedance of the electricity removing member that are calculated from a Cole-Cole plot obtained from measurement in a predetermined frequency range by an AC impedance method, the resistance component of the inner impedance is equal to or lower than a value that is obtained by multiplying a calculated resistance value by a first specific value, the calculated resistance value being calculated based on a predetermined formula as a DC resistance value of the electricity removing member that is required to reduce a pre-electricity-removal potential of the photoconductor to a predetermined post-electricity-removal potential during an electricity removal time that is obtained by dividing a contact width between the photoconductor and the electricity removing member by a linear speed of the photoconductor, the first specific value being calculated based on a ratio of a linear speed of the electricity removing member to the linear speed of the photoconductor, and the resistance component of the contact impedance is equal to or lower than a value that is obtained by multiplying the calculated resistance value by a second specific value that is calculated based on the ratio of the linear speed of the electricity removing member to the linear speed of the photoconductor.

2. The image forming apparatus according to claim 1, wherein when A1 denotes the first specific value, A2 denotes the second specific value, and Sr denotes the ratio, the first specific value A1 is calculated based on a following formula (1), and the second specific value A2 is calculated based on a following formula (2):

[Math8]

$$A1=3\times\{1+(|1-Sr|\times1.9)\} \quad (1)$$

[Math9]

$$A2=1.2\times\{1+(|1-Sr|\times1.9)\} \quad (2)$$

3. The image forming apparatus according to claim 2, wherein when C denotes a capacitance of the photoconductor, t denotes the electricity removal time, V0 denotes the pre-electricity-removal potential, V1 denotes the post-electricity-removal potential, and R21 denotes the calculated resistance value, the calculated resistance value R21 is calculated based on a following formula (3):

[Math10]

$$V1=V0\times e^{-t/(R21\cdot C)} \quad (3)$$

4. The image forming apparatus according to claim 3, comprising:

a charging member configured to charge the photoconductor;

a voltage change portion configured to change an application voltage that is applied to the charging member; and a speed change portion configured to increase a difference between the linear speed of the photoconductor and the linear speed of the electricity removing member as the application voltage applied to the charging member increases.

5. The image forming apparatus according to claim 4, wherein when Ra denotes the resistance component of the inner impedance, Rb denotes the resistance component of the contact impedance, and R22 denotes a calculated resistance value calculated after the application voltage is changed by the voltage change portion, the speed change portion changes the linear speed of the electricity removing member so that the ratio Sr satisfies following formulas (4) and (5):

[Math 11]

$$Ra\leq R22\times3\times\{1+(|1-Sr|\times1.9)\} \quad (4)$$

[Math 12]

$$Rb\leq R22\times1.2\times\{1+(|1-Sr|\times1.9)\} \quad (5)$$

6. The image forming apparatus according to claim 5, wherein the speed change portion changes the linear speed of the electricity removing member to a specific speed so that the ratio Sr satisfies the formula (4) and (5) and a difference from the linear speed of the photoconductor becomes a minimum, or changes the linear speed of the electricity removing member so that the difference from the specific speed becomes equal to or smaller than a preset allowed value.

7. The image forming apparatus according to claim 1, wherein the linear speed of the electricity removing member is faster than the linear speed of the photoconductor.

8. The image forming apparatus according to claim 1, wherein the linear speed of the electricity removing member is slower than the linear speed of the photoconductor.

9. The image forming apparatus according to claim 1, wherein with regard to a capacitance component of the inner impedance and a capacitance component of the contact impedance, a value obtained by dividing the capacitance component of the contact impedance by the capacitance component of the inner impedance is equal to or lower than a predetermined third specific value, and the capacitance component of the inner impedance is equal to or lower than predetermined fourth specific value.

10. The image forming apparatus according to claim 9, wherein the third specific value is 0.4, and the fourth specific value is 1.0E+05.

11. The image forming apparatus according to claim 1, wherein the photoconductor is charged by a contact-type charging member.

12. The image forming apparatus according to claim 1, wherein the photoconductor is charged by application of a DC voltage.

13. The image forming apparatus according to claim 1, wherein the electricity removing member includes a basic body portion and brush bristles, the basic body portion being cylindrical, one end of the brush bristles being fixed to the basic body portion, the other end of the brush bristles being brought into contact with the surface of the photoconductor, and each of the brush bristles includes a core portion and a surface layer portion, the core portion being made of resin, the surface layer portion being made of carbon and covering a surface of the core portion.

14. The electricity removing member used in the image forming apparatus according to claim 1.

* * * * *